US011613130B2

(12) United States Patent
Kondo et al.

(10) Patent No.: US 11,613,130 B2
(45) Date of Patent: Mar. 28, 2023

(54) SEALING MEMBER, METHOD OF MANUFACTURING THE SAME, PRESSURE ADJUSTMENT MECHANISM, LIQUID EJECTION HEAD, AND LIQUID EJECTION APPARATUS

(71) Applicant: CANON KABUSHIKI KAISHA, Tokyo (JP)

(72) Inventors: Soji Kondo, Kanagawa (JP); Kazuya Yoshii, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 17/410,844

(22) Filed: Aug. 24, 2021

(65) Prior Publication Data

US 2022/0063288 A1 Mar. 3, 2022

(30) Foreign Application Priority Data

Sep. 1, 2020 (JP) ..... JP2020-146590
May 10, 2021 (JP) ..... JP2021-079808

(51) Int. Cl.
*B41J 2/175* (2006.01)
*B41J 2/18* (2006.01)
*B41J 2/03* (2006.01)

(52) U.S. Cl.
CPC ..... *B41J 2/17596* (2013.01); *B41J 2/17563* (2013.01); *B41J 2/18* (2013.01);
(Continued)

(58) Field of Classification Search
CPC .... B41J 2/175; B41J 2/17506; B41J 2/17509; B41J 2/17513; B41J 2/17523;
(Continued)

(56) References Cited

U.S. PATENT DOCUMENTS 5,502,479 A * 3/1996 Ishinaga ..... B41J 2/17563 347/93
6,170,939 B1 * 1/2001 Ujita ..... B41J 2/17513 347/86

(Continued)

FOREIGN PATENT DOCUMENTS

JP 2017-124620 7/2017
JP 2017124620 7/2017

OTHER PUBLICATIONS

Extended European Search Report dated Jan. 18, 2022 in counterpart EP Application No. 21193088.8.

(Continued)

*Primary Examiner* — Anh T Vo
(74) *Attorney, Agent, or Firm* — Venable LLP

(57) ABSTRACT

Provided is a sealing member to be used as a valve in a pressure adjustment mechanism. The sealing member includes a base member having high strength, and has high reliability. The sealing member includes an elastic member (valve portion) having an annular abutment portion (valve distal end portion) formed as an annular protrusion and the base member (lever portion). When a held portion having a tubular shape extending from the annular abutment portion is held in an annular groove formed in the base member, the elastic member is fixed to the base member. A holding length over which an annular groove holds the held portion along a depth direction of the base member is set longer than a width of the annular groove.

15 Claims, 24 Drawing Sheets

(52) U.S. Cl.
CPC ..... *B41J 2/03* (2013.01); *B41J 2202/05* (2013.01); *B41J 2202/20* (2013.01)

(58) Field of Classification Search
CPC ..... B41J 2/17553; B41J 2/17556; B41J 2/17563; B41J 2/17596; B41J 2/03; B41J 2/18; B41J 2202/05; B41J 2202/20
See application file for complete search history.

(56) References Cited

U.S. PATENT DOCUMENTS

| | | | | |
|---|---|---|---|---|
| 9,914,308 | B2 | 3/2018 | Yamada et al. | B41J 2/1404 |
| 9,925,791 | B2 | 3/2018 | Yamada | B41J 2/14024 |
| 10,195,868 | B2 | 2/2019 | Yamada et al. | B41J 2/175 |
| 2017/0197432 | A1 | 7/2017 | Yamada et al. | B41J 2202/20 |
| 2019/0168508 | A1 | 6/2019 | Kondo | B41J 2/1752 |
| 2019/0291455 | A1 | 9/2019 | Eto | B41J 2/175 |
| 2020/0047202 | A1* | 2/2020 | Hennemann | B05B 11/104 |
| 2020/0086651 | A1 | 3/2020 | Eto | B41J 2/17523 |
| 2020/0249705 | A1 | 8/2020 | Yoshii et al. | B41J 2/17553 |

OTHER PUBLICATIONS

Office Action dated Mar. 11, 2022 in counterpart India Application No. 202144038922, together with English translation thereof.

* cited by examiner

SEALING MEMBER, METHOD OF MANUFACTURING THE SAME, PRESSURE ADJUSTMENT MECHANISM, LIQUID EJECTION HEAD, AND LIQUID EJECTION APPARATUS

BACKGROUND OF THE INVENTION

Field of the Invention

The present invention relates to a sealing member that can be used as, for example, a valve in a pressure adjustment mechanism, a method of manufacturing the sealing member, a pressure adjustment mechanism using the sealing member, a liquid ejection head, and a liquid ejection apparatus.

Description of the Related Art

There exists a liquid ejection apparatus represented by an inkjet recording apparatus, inside which a liquid is circulated. When the liquid is to be circulated inside the apparatus, a pressure adjustment mechanism configured to control a pressure of the liquid to be circulated is provided. A liquid ejection apparatus disclosed in Japanese Patent Application Laid-Open No. 2017-124620 includes a back-pressure type pressure adjustment mechanism configured to keep a back pressure constant. The back-pressure type pressure adjustment mechanism includes a first pressure chamber, a second pressure chamber, a valve, and a pressure-receiving plate. The first pressure chamber is fluidically sealed with a flexible member. The second pressure chamber is provided on a downstream side of the first pressure chamber. The valve is configured to variably change flow resistance between the first pressure chamber and the second pressure chamber. The pressure-receiving plate is configured to be displaced in accordance with an increase and decrease of the liquid in the first pressure chamber. The valve is provided in the first pressure chamber. The valve includes a valve body to be moved in accordance with the displacement of the pressure-receiving plate to change the flow resistance on the liquid flowing from the first pressure chamber into the second pressure chamber. In this manner, the valve operates so as to maintain a function of keeping a pressure in the first pressure chamber, that is, a back pressure constant.

In the pressure adjustment mechanism, the valve is formed as a sealing member obtained by joining an elastic member to a base member. The elastic member serves as the valve body. The base member is moved in accordance with the displacement of the pressure-receiving plate. A large separating force is applied between the elastic member and the base member. When the elastic member is joined to the base member with use of an adhesive, sufficient reliability is not obtained. When the valve is manufactured by assembling and molding the elastic member and the base member through two-color molding, it is difficult to use a material having high strength for the base member.

An object of the present invention is to provide a sealing member with high reliability, which includes a base member having high strength and is to be used in, for example, a pressure adjustment mechanism, a method of manufacturing the sealing member, a pressure adjustment mechanism using the sealing member, a liquid ejection head, and a liquid ejection apparatus.

SUMMARY OF THE INVENTION

A sealing member according to the present invention includes: an elastic member having an annular abutment portion formed as an annular protrusion; and a base member to which the elastic member is to be fixed, wherein the elastic member has a held portion having a tubular shape extending from the annular abutment portion and is fixed to the base member when the held portion is held in an annular groove formed in the base member, and a holding length over which the annular groove holds the held portion along a depth direction of the base member is longer than a width of the annular groove.

A method of manufacturing a sealing member according to the present invention is a method of manufacturing the sealing member of the present invention, the method including integrally assembling and molding the elastic member and the base member in a die through injection molding.

A pressure adjustment mechanism according to the present invention includes: a liquid storage chamber, which has an outer wall formed at least partially of a flexible film, and is configured to store a liquid; an opening configured to communicate with the liquid storage chamber; a pressing plate configured to be displaced in accordance with displacement of the flexible film; a first urging member configured to urge the pressing plate in a direction of expanding the liquid storage chamber; and the sealing member of the present invention, wherein the sealing member is arranged in such a manner that a distance between the elastic member of the sealing member and the opening is changed in accordance with the displacement of the pressing plate to change flow resistance to the liquid flowing through the opening so as to adjust a pressure of the liquid in the liquid storage chamber.

A liquid ejection head according to the present invention includes: a plurality of recording element boards each including: ejection orifices; recording elements configured to generate energy for ejecting a liquid from the ejection orifices; and a pressure chamber including the recording elements; a pair of common flow paths configured to communicate with the plurality of recording element boards; a plurality of individual flow paths configured to connect one of the pair of common flow paths to another one of the common flow paths and communicate with the plurality of pressure chambers, respectively; and a pair of the pressure adjustment mechanisms of the present invention, which are to be connected to one of an upstream side and a downstream side of the pair of common flow paths, and are to be set at pressures different from each other. A liquid ejection apparatus according to the present invention includes: a liquid storage reservoir configured to store a liquid; the liquid ejection head of the present invention; and a circulation mechanism configured to circulate the liquid through a circulation path including the pair of common flow paths.

Further features of the present invention will become apparent from the following description of exemplary embodiments with reference to the attached drawings.

DESCRIPTION OF THE EMBODIMENTS

Embodiments of the present invention are described with reference to the drawings. A sealing member according to the present invention is obtained by joining an elastic member made of a soft material to a base member made of a material having high stiffness. The sealing member is configured to establish an airtight state or change flow resistance in, for example, a valve as needed. The elastic member has a function of maintaining the airtight state, for example, by being brought into contact with a surface around an opening through which a liquid flows as needed. Such a sealing member is used as a valve in a pressure adjustment mechanism having, for example, a back-pressure valve mechanism or a pressure-reducing valve mechanism. The sealing member is also used to regulate a flow direction of a fluid in, for example, a check valve, or is used as a gasket to prevent leakage of a fluid. Further, the elastic member is also used to cover a specific region in an airtight manner as needed so as to prevent exposure of the specific region to an atmosphere. In the following, the sealing member according to the present invention which is used as a valve in a pressure adjustment mechanism is mainly described. For understanding of the present invention, a liquid ejection apparatus, which is an example of an apparatus using a pressure adjustment mechanism, is first described. It is apparent that an apparatus to which the pressure adjustment mechanism according to the present invention is applicable is not limited to the liquid ejection apparatus.

(Liquid Ejection Apparatus)

Figure 1:
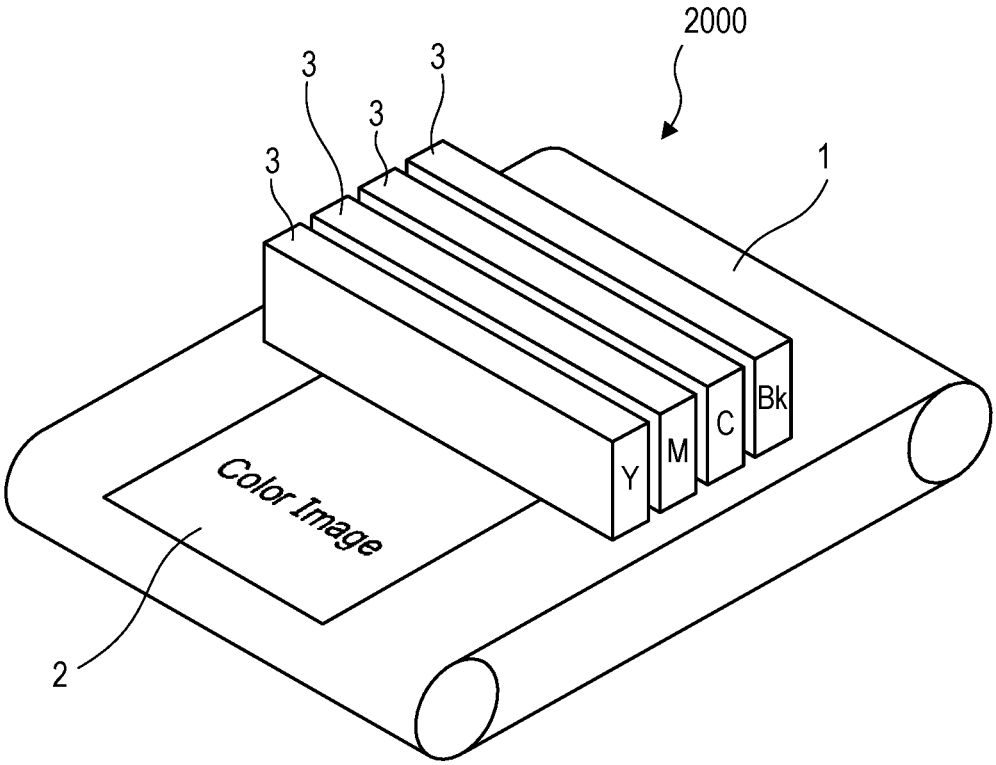
FIG. 1 is a view for illustrating a schematic configuration of a liquid ejection apparatus.

A liquid ejection apparatus is configured to eject a liquid from ejection orifices. As an example of the liquid ejection apparatus, there is given an inkjet recording apparatus configured to eject a recording liquid such as an ink from ejection orifices onto a recording medium such as a paper sheet to record an image on the recording medium. FIG. 1 is a view for illustrating a schematic configuration of a liquid ejection apparatus 2000 formed as an inkjet recording apparatus configured to eject a liquid onto a recording medium 2 to perform recording on the recording medium 2. The liquid ejection apparatus 2000 includes a conveyance portion 1 and four liquid ejection heads 3. The conveyance portion 1 is configured to convey the recording medium 2. The four liquid ejection heads 3 are arranged so as to be parallel to each other and substantially orthogonal to a conveyance direction for the recording medium 2. The liquid ejection apparatus 2000 ejects a liquid from the liquid ejection heads 3 while conveying the recording medium 2. The four liquid ejection heads 3 are configured to eject recording liquids, that is, inks of cyan (C), magenta (M), yellow (Y), and black (K), respectively. The colors of cyan (C), magenta (M), yellow (Y), and black (K) are hereinafter also collectively referred to as "CMYK". With the liquid ejection heads 3 for four colors, the liquid ejection apparatus 2000 can perform full-color recording on the recording medium 2. As described later, a supply system in the liquid ejection apparatus 2000, that is, a buffer tank 1003 (see FIG. 2 and FIG. 3) and a main tank 1006 (see FIG. 2 and FIG. 3), which are liquid storage reservoirs configured to store a liquid, are fluidically connected to the liquid ejection heads 3. Further, an electric control unit configured to transmit electric power and an ejection control signal to each of the liquid ejection heads 3 is electrically connected to the liquid ejection heads 3.

The liquid ejection apparatus 2000 described herein is configured to circulate a liquid such as a recording liquid between the buffer tank 1003 and the liquid ejection heads 3. The liquid ejection apparatus 2000 has a first circulation mode and a second circulation mode as modes in which a liquid is circulated in the liquid ejection apparatus 2000. Specifically, in the first circulation mode, two circulation pumps respectively for a high pressure and a low pressure are operated on a downstream side of the liquid ejection heads 3 so as to circulate a liquid. In the second circulation mode, two circulation pumps similar to those described above are operated on an upstream side of the liquid ejection heads 3. Now, the first circulation mode and the second circulation mode are described.

(First Circulation Mode)

Figure 2:
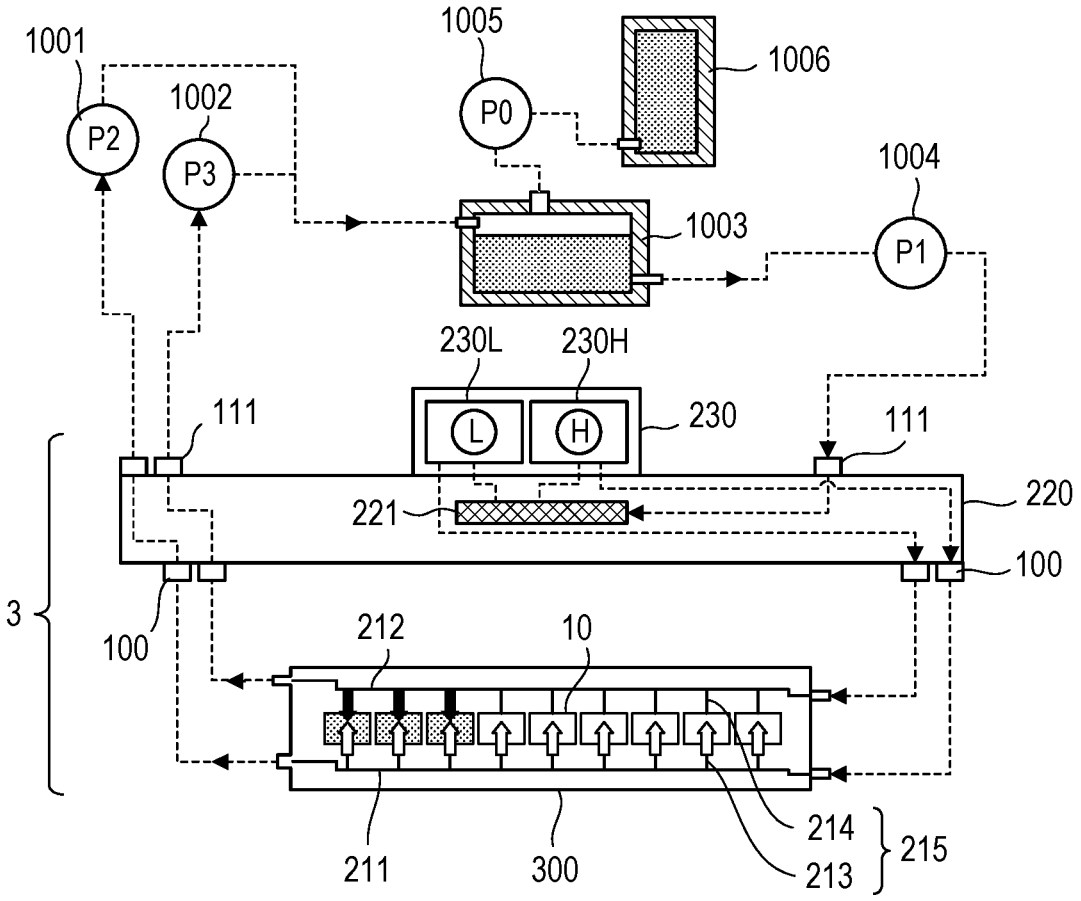
FIG. 2 is a diagram for illustrating a first circulation mode.

FIG. 2 is a schematic diagram for illustrating the first circulation mode to be employed in the liquid ejection apparatus 2000. In the first circulation mode, the liquid ejection heads 3 are fluidically connected to, for example, a first circulation pump 1001 on a high pressure side, a first circulation pump 1002 on a low pressure side, and the buffer tank 1003. In FIG. 2, for simplification of description, only a flow path through which the recording liquid of one of the colors of CMYK flows is illustrated. In practice, however, the flow path illustrated in FIG. 2 is formed for each of the liquid ejection heads 3 in the liquid ejection apparatus 2000. The buffer tank 1003 serving as a sub-tank is connected to the main tank 1006. The buffer tank 1003 has an atmosphere communication port (not shown) for bringing an inside and an outside of the buffer tank 1003 into communication with each other. The atmosphere communication port enables discharge of air bubbles in the recording liquid to the outside of the buffer tank 1003. The buffer tank 1003 is also connected to a replenishment pump 1005. After the recording liquid is ejected (discharged) from the ejection orifices of the liquid ejection head 3 and is consumed for recording, suction recovery, or the like, the replenishment pump 1005 transfers the recording liquid from the main tank 1006 to the buffer tank 1003 by the amount corresponding to the amount of consumption.

The liquid ejection head 3 includes a liquid ejection unit 300 and a liquid supply unit 220. The liquid ejection unit 300 has the ejection orifices. The liquid supply unit 220 includes a pressure control unit 230 configured to adjust a pressure of the liquid circulated through the liquid ejection unit 300. The liquid ejection unit 300 includes a plurality of recording element boards 10, a common supply flow path 211, and a common collection flow path 212. The common supply flow path 211 and the common collection flow path 212 form part of a circulation path for the liquid. The common supply flow path 211 and the common collection flow path 212 form a pair of common flow paths. As described later, the recording liquid supplied to the buffer tank 1003 is supplied by a second circulation pump 1004 to the liquid supply unit 220 via a liquid connection portion 111 of the liquid ejection head 3.

The two first circulation pumps 1001 and 1002 serve to suck the liquid through a liquid connection portion 111 of the liquid ejection head 3 to cause the liquid to flow to the buffer tank 1003. As the first circulation pumps 1001 and 1002, it is preferred that displacement pumps having quantitative liquid feeding capability be used. More specifically, a tube pump, a gear pump, a diaphragm pump, and a syringe pump are given as examples. However, for example, a pump including a general flow control valve or relief valve provided at a pump outlet so as to ensure a constant flow rate may also be used. Further, it is also preferred that a flow rate sensor be provided in the circulation path and used to control the revolving speed of the pump through a control circuit included in a main body based on a sensor output value so as to ensure a constant flow rate. When the liquid ejection head 3 is driven, the recording liquid is caused to flow at a constant flow rate through the common supply flow path 211 and the common collection flow path 212 of the liquid ejection unit 300 by the first circulation pump 1001 on the high pressure side and the first circulation pump 1002 on the low pressure side, respectively. Through the flow of the recording liquid as described above, a temperature of the liquid ejection head 3 during recording is maintained to an optimal temperature. It is preferred that the flow rate of the recording liquid be set equal to or larger than such a flow rate that a temperature difference among the recording element boards 10 in the liquid ejection head 3 does not affect quality of recording on the recording medium 2. However, when an excessively large flow rate is set, a negative-pressure difference among the recording element boards 10 becomes too large under effects of a pressure loss in a flow path in the liquid ejection unit 300. As a result, density unevenness occurs in a recorded image. Thus, it is preferred that the flow rate be set in consideration of a temperature difference and a negative-pressure difference among the recording element boards 10.

The pressure control unit 230 is provided in a path between the second circulation pump 1004 and the liquid ejection unit 300. The recording liquid is supplied to the pressure control unit 230 from the second circulation pump 1004 through a filter 221. Even when the flow rate of the recording liquid in a circulation system varies, the pressure control unit 230 operates so as to maintain a pressure on a downstream side of the pressure control unit 230 (that is, the liquid ejection head 3 side) to a preset constant pressure. A change in flow rate of the recording liquid in the circulation system occurs due to a change in ejection amount per unit area, which is caused when, for example, the recording liquid is ejected to the recording medium 2 to perform recording. The pressure control unit 230 includes two pressure adjustment mechanisms 230H and 230L, in which different control pressures are set, respectively. In FIG. 2, the letter "H" represents a "high pressure" for the pressure adjustment mechanism 230H on a high pressure side, and the letter "L" represents a "low pressure" for the pressure adjustment mechanism 230L on a low pressure side. The two pressure adjustment mechanisms 230H and 230L may be any mechanism that can control the pressure on the downstream side of the pressure control unit 230 in such a manner that a fluctuation in pressure falls within a given range including a desired control pressure as a central value. As an example, a mechanism similar to a so-called pressure reducing valve or pressure reducing regulator can be used. When an upstream side of the pressure control unit 230 is pressurized by the second circulation pump 1004 through the liquid supply unit 220 as in the first circulation mode, effects of a water head pressure of the buffer tank 1003 on the liquid ejection head 3 can be suppressed. As a result, a degree of freedom in layout of the buffer tank 1003 in the liquid ejection apparatus 2000 can be increased. As the second circulation pump 1004, any pump that has a lifting pressure equal to or larger than a given pressure while the flow rate falls within a range of a circulating flow rate of the recording liquid used at the time of driving of the liquid ejection head 3 may be used. For example, a turbo pump or a displacement pump may be used. More specifically, for example, a diaphragm pump can be used. Further, in place of the second circulation pump 1004, for example, a water head tank may be arranged with a given water head difference with respect to the pressure control unit 230.

The pressure adjustment mechanism 230H of the two pressure adjustment mechanisms in the pressure control unit 230, to which a relatively high pressure is set, is connected to an inlet of the common supply flow path 211 in the liquid ejection unit 300 through intermediation of a liquid connection portion 100 via the liquid supply unit 220. Similarly, the pressure adjustment mechanism 230L, to which a relatively low pressure is set, is connected to an inlet of the common collection flow path 212 in the liquid ejection unit 300 through intermediation of a liquid connection portion 100 via the liquid supply unit 220. Outlets of the common supply flow path 211 and the common collection flow path 212 are connected to the first circulation pumps 1001 and 1002, respectively, through the liquid connection portions 100, the liquid supply unit 220, and the liquid connection portions 111. As a result, a high pressure-side circulation path from the buffer tank 1003 via the second circulation pump 1004, the pressure adjustment mechanism 230H on the high pressure side, the common supply flow path 211, and the first circulation pump 1001 on the high pressure side to return to the buffer tank 1003 is formed. Further, a low pressure-side circulation path from the buffer tank 1003 via the second circulation pump 1004, the pressure adjustment mechanism 230L on the low pressure side, the common collection flow path 212, and the first circulation pump 1002 on the low pressure side to return to the buffer tank 1003 is formed. The first circulation pumps 1001 and 1002, the second circulation pump 1004, and the pressure control unit 230 correspond to a circulation mechanism configured to circulate the liquid in the first circulation mode.

The liquid ejection unit 300 includes not only the plurality of recording element boards 10, the common supply flow path 211, and the common collection flow path 212 but also individual supply flow paths 213 and individual collection flow paths 214. The individual supply flow paths 213 and the individual collection flow paths 214 communicate with the recording element boards 10, respectively. The individual supply flow path 213 and the individual collection flow path 214, which are formed for each recording element board 10, are collectively referred to as an individual flow path 215. The individual flow paths 215 branch from the common supply flow path 211 at a relatively high pressure to join the common collection flow path 212 at a relatively low pressure, and communicate with the common supply flow path 211 and the common collection flow path 212. Thus, a flow (indicated by outlined arrows in FIG. 2) of part of a liquid such as a recording liquid passing from the common supply flow path 211 through internal flow paths in the recording element boards 10 toward the common collection flow path 212 is generated. The flow is generated for the following reason. The pressure adjustment mechanism 230H on the high pressure side is connected to the common supply flow path 211, and the pressure adjustment mechanism 230L on the low pressure side is connected to the common collection flow path 212. Hence, a pressure difference is generated between the common supply flow path 211 and the common collection flow path 212.

In the liquid ejection unit 300, a flow is generated in such a manner that the liquid is caused to flow through the common supply flow path 211 and the common collection flow path 212 and part of the liquid passes through each of the recording element boards 10. Thus, heat generated in each of the recording element boards 10 can be released to an outside of the recording element boards 10 with the flow through the common supply flow path 211 and the common collection flow path 212. Further, while recording is performed with use of the liquid ejection head 3, a flow of the recording liquid can be generated even through the ejection orifices and pressure chambers, which are not performing recording. Thus, an increase in viscosity of the recording liquid in the regions described above due to evaporation of a solvent component of the recording liquid can be suppressed. Further, the recording liquid having an increased viscosity and a foreign substance in the recording liquid can be discharged into the common collection flow path 212. Thus, the use of the liquid ejection heads 3 described above enables high-speed and high-quality recording.

(Second Circulation Mode)

Figure 3:
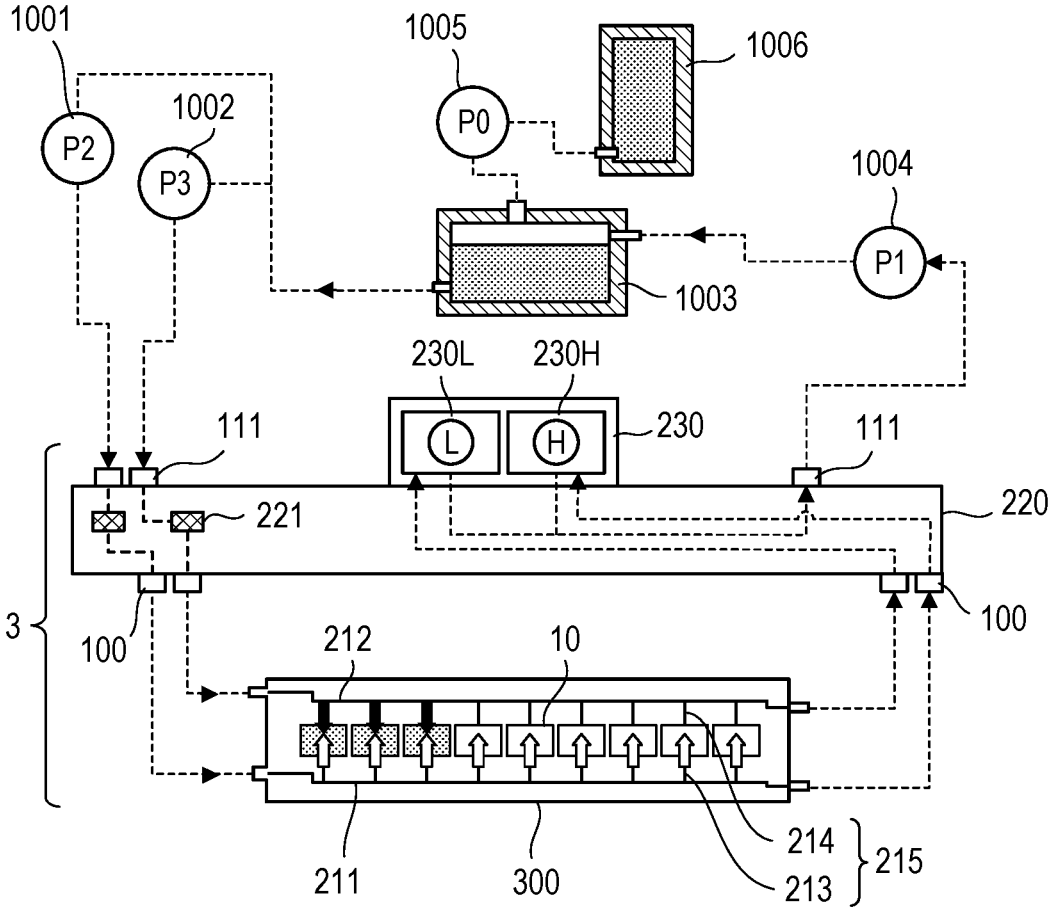
FIG. 3 is a diagram for illustrating a second circulation mode.

FIG. 3 is a schematic view for illustrating the second circulation mode of the liquid ejection apparatus 2000. A main difference from the first circulation mode described above lies in that two pressure adjustment mechanisms 230H and 230L that form the pressure control unit 230 control a pressure on the upstream side of the pressure control unit 230 so that a fluctuation in pressure falls within a given range including a desired set pressure as a central value. As a result, the second circulation pump 1004 acts as a negative-pressure source for reducing a pressure on the downstream side of the pressure control unit 230. The first circulation pump 1001 on the high pressure side and the first circulation pump 1002 on the low pressure side are arranged on the upstream side of the liquid ejection head 3, and the pressure control unit 230 is arranged on the downstream side of the liquid ejection head 3.

In the second circulation mode, the recording liquid in the main tank 1006 is supplied to the buffer tank 1003 by the replenishment pump 1005, and then branches into a flow path on the high pressure side and a flow path on the low pressure side. In the flow path on the high pressure side, the recording liquid is supplied to the common supply flow path 211 through a corresponding one of the filters 221 by the first circulation pump 1001. The recording liquid discharged from the common supply flow path 211 passes through the pressure adjustment mechanism 230H on the high-pressure set side to join a flow in the flow path on the low pressure side, and circulates to flow into the buffer tank 1003 via the second circulation pump 1004. Meanwhile, in the flow path on the low pressure side, the recording liquid is supplied to the common collection flow path 212 through another one of the filters 221 by the first circulation pump 1002. The recording liquid discharged from the common collection flow path 212 passes through the pressure adjustment mechanism 230L on the low-pressure set side to join a flow in the flow path on the high pressure side, and circulates to flow into the buffer tank 1003 via the second circulation pump 1004. Even in the second circulation mode, the pressure in the common supply flow path 211 becomes relatively higher than the pressure in the common collection flow path 212 due to the presence of two pressure adjustment mechanisms 230H and 230L. As a result, a flow of the recording liquid flowing from the common supply flow path 211 via the individual flow paths 215 into the common collection flow path 212 is generated. The first circulation pumps 1001 and 1002, the second circulation pump 1004, and the pressure control unit 230 correspond to a circulation mechanism configured to circulate the liquid.

In the second circulation mode, even when the flow rate of the circulating recording liquid varies, the pressure control unit 230 maintains a fluctuation in pressure on the upstream side (that is, the liquid ejection head 3 side) of the pressure control unit 230 in such a manner that the fluctuation in pressure falls within a given range including a preset pressure as a central value. The pressure adjustment mechanisms 230H and 230L included in the pressure control unit 230 may be any mechanism that can maintain a pressure as described above. As an example, a mechanism referred to as a so-called back-pressure valve or back-pressure regulator may be employed. In the circulation flow path in the second circulation mode, the pressure on the downstream side of the pressure control unit 230 is reduced through the liquid supply unit 220 by the second circulation pump 1004. In this manner, the effects of the water head pressure of the buffer tank 1003 on the liquid ejection head 3 can be suppressed. Thus, a wider range of selection for the layout of the buffer tank 1003 in the liquid ejection apparatus 2000 can be provided. In place of the second circulation pump 1004, for example, a water head tank that is arranged with a predetermined water head difference with respect to the pressure control unit 230 may be used.

Even in the second circulation mode, a flowing state of the recording liquid, which is similar to that in the first circulation mode, is obtained inside the liquid ejection unit 300. However, the second circulation mode has two advantages, which are different from advantages of the first circulation mode. The first advantage is that flow of dust or a foreign substance, which has entered the pressure control unit 230, into the liquid ejection heads 3 is prevented. Each of the pressure adjustment mechanisms 230H and 230L that form the pressure control unit 230 has a valve, and dust or a foreign substance may enter the pressure control unit 230 along with opening and closing of the valve. In the second circulation mode, the pressure control unit 230 is arranged on the downstream side of the liquid ejection head 3, and the filters 221 are arranged on the upstream side of the liquid ejection head 3. Thus, when the recording liquid is circulated through the circulation path by operating the first circulation pumps 1001 and 1002 and the second circulation pump 1004, a foreign substance, which has entered the pressure control unit 230, can be removed from the recording liquid so as to prevent flow of the foreign substance into the liquid ejection head 3.

Figure 4:
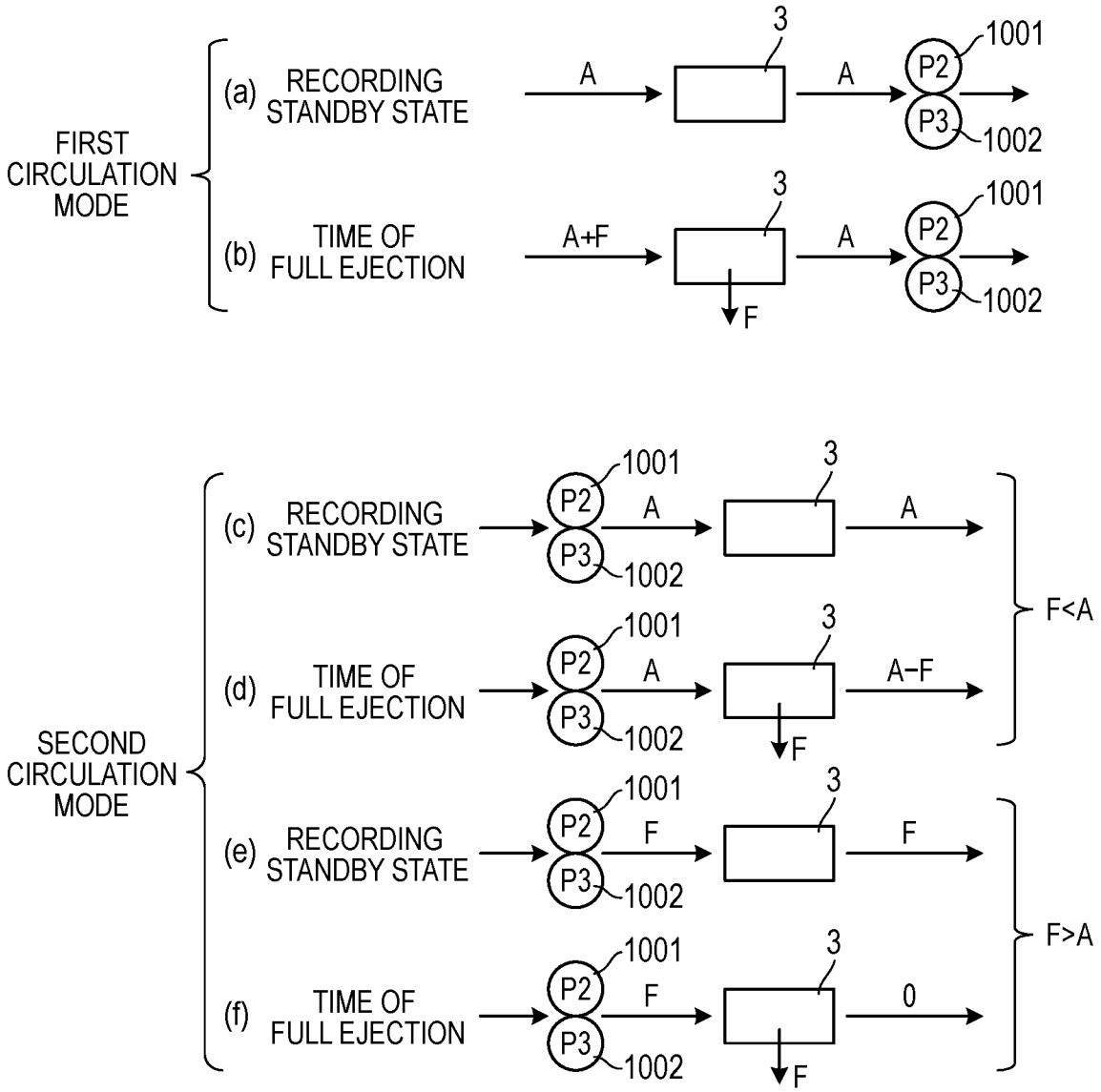
FIG. 4 is a view for illustrating an inflow amount of a liquid into a liquid ejection head.

The second advantage is that a maximum value of a required flow rate to be supplied from the buffer tank 1003 to the liquid ejection head 3 is reduced from that in the first circulation mode. The reason is as follows. A total flow rate of the flow rates in the common supply flow path 211, the common collection flow path 212, and the individual flow paths 215 when the recording liquid is circulated under a recording standby state is defined as a flow rate A. A value of the flow rate A is defined as a minimum flow rate that is required to set a temperature difference in the liquid ejection unit 300 within a desired range when a temperature of the liquid ejection head 3 is adjusted under the recording standby state. Further, an ejection flow rate when the recording liquid is ejected from all the ejection orifices of the liquid ejection unit 300 (at a time of full ejection) is defined as a flow rate F. The flow rate F is defined as a product of an ejection amount of recording liquid per ejection orifice for one ejection, the number of times of ejection (that is, an ejection frequency) per unit time, and the number of ejection orifices. FIG. 4 is a schematic diagram for illustrating differences in inflow rate of the recording liquid to the liquid ejection head 3 between the first circulation mode and the second circulation mode. Part (a) of FIG. 4 represents an inflow rate under the recording standby state in the first circulation mode. Part (b) of FIG. 4 represents an inflow rate at the time of full ejection in the first circulation mode. Part (c) to Part (f) of FIG. 4 represent inflow rates of the recording liquid in the second circulation mode. Part (c) and Part (d) of FIG. 4 represent a case in which the flow rate F is smaller than the flow rate A, and Part (e) and Part (f) of FIG. 4 represent a case in which the flow rate F is larger than the flow rate A. Each of Part (c) and Part (e) of FIG. 4 represents a flow rate under the recording standby state, and each of Part (d) and Part (f) of FIG. 4 represents a flow rate at the time of full ejection.

In the case of the first circulation mode (Parts (a) and (b) of FIG. 4) in which the first circulation pumps 1001 and 1002 having quantitative liquid feeding capability are arranged on the downstream side of the liquid ejection head 3, a total set flow rate of the first circulation pumps 1001 and 1002 is equal to the flow rate A. The flow rate A enables temperature control in the liquid ejection unit 300 under the standby state. When the full ejection is performed by the liquid ejection head 3, the total set flow rate of the first circulation pumps 1001 and 1002 remains equal to the flow rate A. However, a negative pressure generated by the ejection in the liquid ejection unit 300 affects the flow rate of the recording liquid. Thus, the maximum flow rate of the recording liquid supplied to the liquid ejection head 3 is equal to a result of addition of the amount of consumption (flow rate F) in the full ejection to the flow rate A being the total set flow rate. Thus, a maximum value of the amount of supply to the liquid ejection head 3 at the time of full ejection is equal to the result of addition of the flow rate F to the flow rate A, thus, the flow rate A+the flow rate F (Part (b) of FIG. 4).

The following case in the first circulation mode illustrated in FIG. 2 is now considered. Specifically, some of the plurality of recording element boards 10 are in the recording standby state, and the recording liquid is ejected from all the ejection orifices of the other recording element boards 10. In FIG. 2, hatched ones of the recording element boards 10 represent the recording element boards 10 which are performing the full ejection, and unhatched ones thereof represent the recording element boards 10 which are in the recording standby state. In this case, the recording liquid is supplied from the common supply flow path 211 to the recording element boards 10, which are performing the full ejection, as indicated by outlined arrows in FIG. 2. Besides, a given amount of recording liquid is supplied to the recording element boards 10, which are performing the full ejection, from the common collection flow path 212, as indicated by black arrows in FIG. 2. Meanwhile, the recording liquid is continuously supplied from the common supply flow path 211 to the recording element boards 10, which are in the recording standby state, as indicated by the outlined arrows in FIG. 2. The inflow rate of the recording liquid to the liquid ejection unit 300 increases. Thus, although a pressure difference between the common supply flow path 211 and the common collection flow path 212, which are the common flow paths, fluctuates to some degrees, effects of the pressure difference are negligible as long as a sufficient sectional area of each of the common flow paths is ensured.

As described above, in the first circulation mode, even when some of the recording element boards 10 are in the recording standby state and the other recording element boards 10 perform the full ejection at the same time, the recording liquid is also supplied to the recording element boards 10, which are in the recording standby state. With such a configuration, the amount of supply of the recording liquid to the liquid ejection head 3 can be suitably controlled. Specifically, the pressure difference between the common flow paths is controlled so that the flow rate of the recording liquid passing through the individual flow paths 215 in the recording element boards 10, which are in the recording standby state, becomes smaller than the ejection flow rate of the recording liquid ejected from all ejection orifices 13 of the recording element boards 10. Through the control of the pressure difference between the common supply flow path 211 and the common collection flow path 212 as described above, the amount of recording liquid to be circulated through the recording element boards 10, which are in the recording standby state, can be reduced regardless of a fluctuation in ejection flow rate from the ejection orifices of the liquid ejection head 3. When the amount of recording liquid to be circulated through the recording element boards 10, which are in the recording standby state, is successfully reduced, dissipation of heat from the liquid ejection head 3 can be suppressed. Thus, for example, a cooling mechanism for cooling the recording liquid in the circulation flow path can be simplified.

In the case of the second circulation mode (Part (c) to Part (f) of FIG. 4) in which the first circulation pumps 1001 and 1002 are arranged on the upstream side of the liquid ejection head 3, the amount of supply of the recording liquid to the liquid ejection head 3, which is required under the recording standby state, is equal to the flow rate A as in the case of the first circulation mode. Thus, in the second circulation mode, when the flow rate A is larger than the flow rate F (Part (c) and Part (d) of FIG. 4), the flow rate A is sufficient as the amount of supply to the liquid ejection head 3 even at the time of full ejection. In this case, a discharge flow rate from the liquid ejection head 3 is equal to flow rate A−flow rate F (Part (d) of FIG. 4). However, when the flow rate F is larger than the flow rate A (Part (e) and Part (f) of FIG. 4) and a supply flow rate to the liquid ejection head 3 at the time of full ejection is set to the flow rate A, the flow rate of the recording liquid is insufficient. Thus, in the second circulation mode, when the flow rate F is larger than the flow rate A, the amount of supply to the liquid ejection head 3 is required to be set to the flow rate F. Further, when the full ejection is performed under this state, the flow rate F is consumed in the liquid ejection head 3. Thus, the discharge flow rate from the liquid ejection head 3 becomes substantially zero (Part (f) of FIG. 4). When the flow rate F is larger than the flow rate A and the ejection, which is not the full ejection, is performed, the recording liquid is discharged from the liquid ejection head 3 at a flow rate obtained by subtracting the amount consumed in the ejection from the flow rate F.

In the second circulation mode, a total value of the set flow rates of the first circulation pumps 1001 and 1002, that is, a maximum value of a required supply flow rate is a larger one of the flow rate A and the flow rate F. Thus, as long as the liquid ejection unit 300 having the same configuration is used, the maximum value (larger one of the flow rate A and the flow rate F) of a required supply flow rate in the second circulation mode is smaller than the maximum value (flow rate A+flow rate F) of a required supply flow rate in the first circulation mode. Also in the second circulation mode, even when some of the recording element boards 10 are in the recording standby state and the remaining recording element boards 10 perform the full ejection, the recording liquid is also supplied to the recording element boards 10, which are in the recording standby state. Further, also in the second circulation mode, the flow rate of the recording liquid to be circulated through the recording element boards 10, which are in the recording standby state, can be reduced through the control of the pressure difference between the common supply flow path 211 and the common collection flow path 212 regardless of a fluctuation in ejection flow rate of the recording liquid from the ejection orifices of the liquid ejection head 3. In the case of the second circulation mode, a degree of freedom in applicable circulation pumps increases. Thus, for example, a low-cost circulation pump having a simple configuration can be used, or a load of a cooler (not shown) installed in a flow path in the main body side can be reduced. Hence, cost of a recording apparatus main body can be reduced. This advantage becomes greater for a page-wide type head having a relatively large value of the flow rate A or F, and becomes more benefitable for the page-wide type head having a longer length in a longitudinal direction.

Meanwhile, the first circulation mode is more advantageous than the second circulation mode in some points. In the second circulation mode, the flow rate through the liquid ejection unit 300 under the recording standby state is maximum. Thus, an image to be recorded requires a smaller ejection amount per unit area (also referred to as "low-duty image"), a higher negative pressure is applied to each of the ejection orifices. When the low-duty image in which recording unevenness liable to be noticeable is recorded, a high negative pressure is applied to the ejection orifices. Thus, a large number of so-called satellite droplets, which are ejected along with main droplets of the recording liquid, may be generated. As a result, recording quality may degrade. Meanwhile, in the case of the first circulation mode, a high negative pressure is applied to the ejection orifices when an image requiring a large ejection amount per unit area (also referred to as "high-duty image") is to be formed. Thus, even when satellite droplets are generated, the satellite droplets are less liable to be visible. Thus, an advantage that the image is less affected by the satellite droplets is obtained. The above-mentioned two circulation modes may be preferably selected in view of specifications of the liquid ejection head 3 and the recording apparatus main body (the ejection flow rate F, the minimum circulation flow rate A, and flow path resistance in the liquid ejection head 3).

(Structure of Liquid Ejection Head)

Figure 5A:
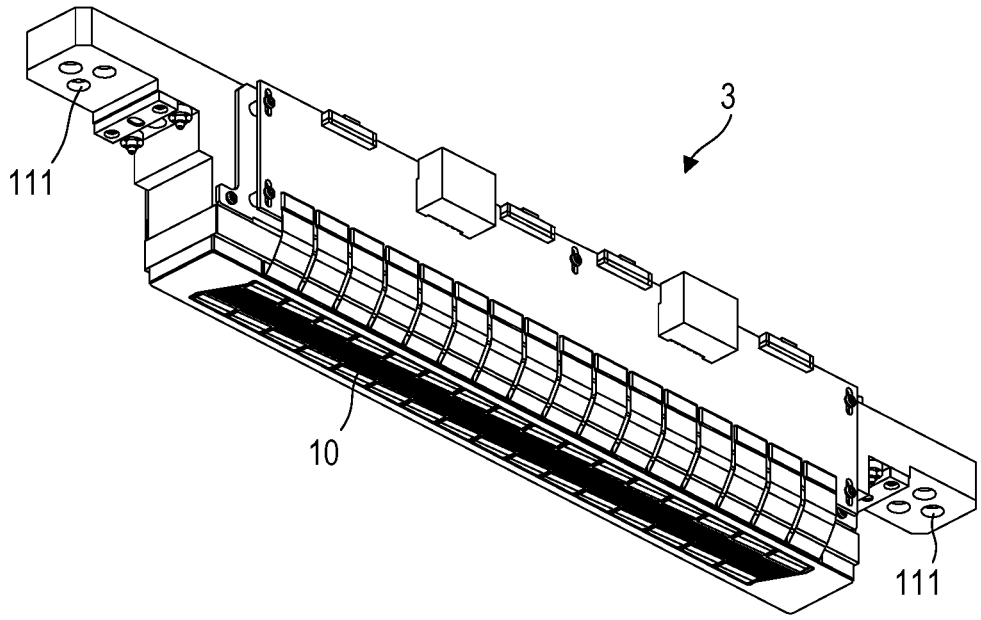
FIG. 5A and FIG. 5B are perspective views for illustrating a configuration of the liquid ejection head.
Figure 5B:
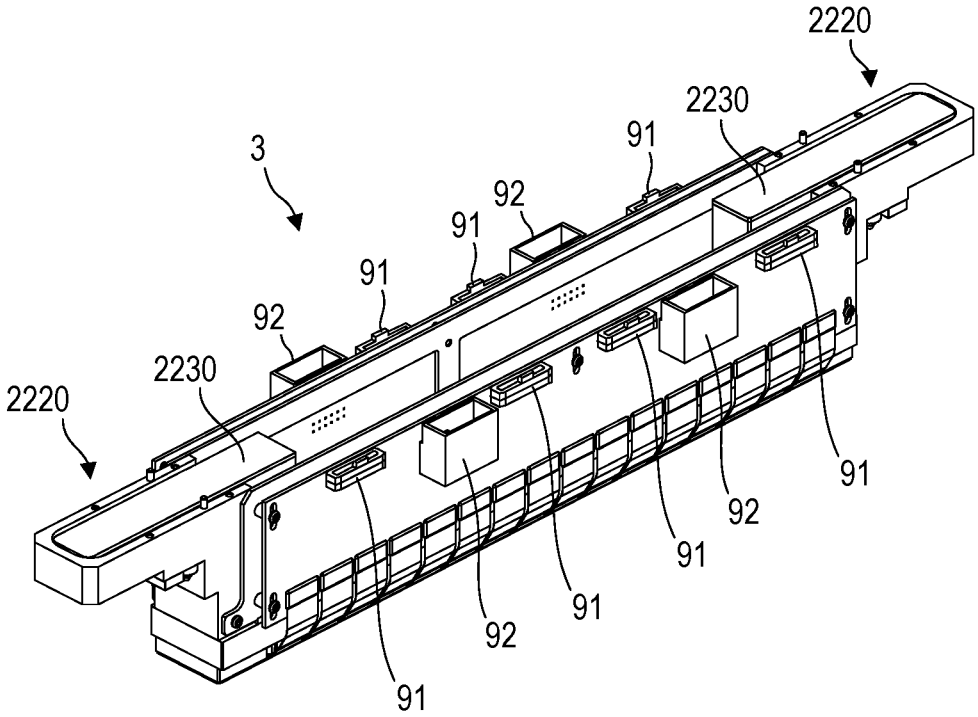

Next, a structure of the liquid ejection head 3 is described with reference to FIG. 5A and FIG. 5B. FIG. 5A is a perspective view of the liquid ejection head 3 when viewed from a side of its surface having the ejection orifices. FIG. 5B is a perspective view when viewed from a side opposite to the side of FIG. 5A. The liquid ejection head 3 is a line-type liquid ejection head including, for example, sixteen recording element boards 10 arranged in a straight line (arranged inline) extending in a longitudinal direction of the liquid ejection head 3. The liquid ejection head 3 is of inkjet type for performing recording with a recording liquid of a single color. The liquid ejection head 3 includes not only the above-mentioned liquid connection portions 111 but also signal input terminals 91 and power supply terminals 92. The liquid connection portions 111 are provided to circulate the recording liquid between the liquid ejection head 3 and the liquid ejection apparatus 2000. The signal input terminals 91 and the power supply terminals 92 are provided on both sides of the liquid ejection head 3. The signal input terminals 91 and the power supply terminals 92 are provided so as to reduce a decrease in voltage and a delay in signal transmission, which occur in a wiring portion provided to each of the recording element boards 10. In the circulation modes illustrated in FIG. 2 and FIG. 3, one liquid supply unit 220 is provided to the liquid ejection head 3, and one pressure control unit 230 is mounted to the liquid supply unit 220. The pressure control unit 230 includes the two pressure adjustment mechanism 230H and 230L. However, the liquid ejection head 3 described below includes two liquid supply units 2220, and a pressure control unit 2230 including one pressure adjustment mechanism is provided to each of the liquid supply units 2220. The two liquid supply units 2220 are provided at both ends of the liquid ejection head 3 in the longitudinal direction, respectively.

Figure 6:
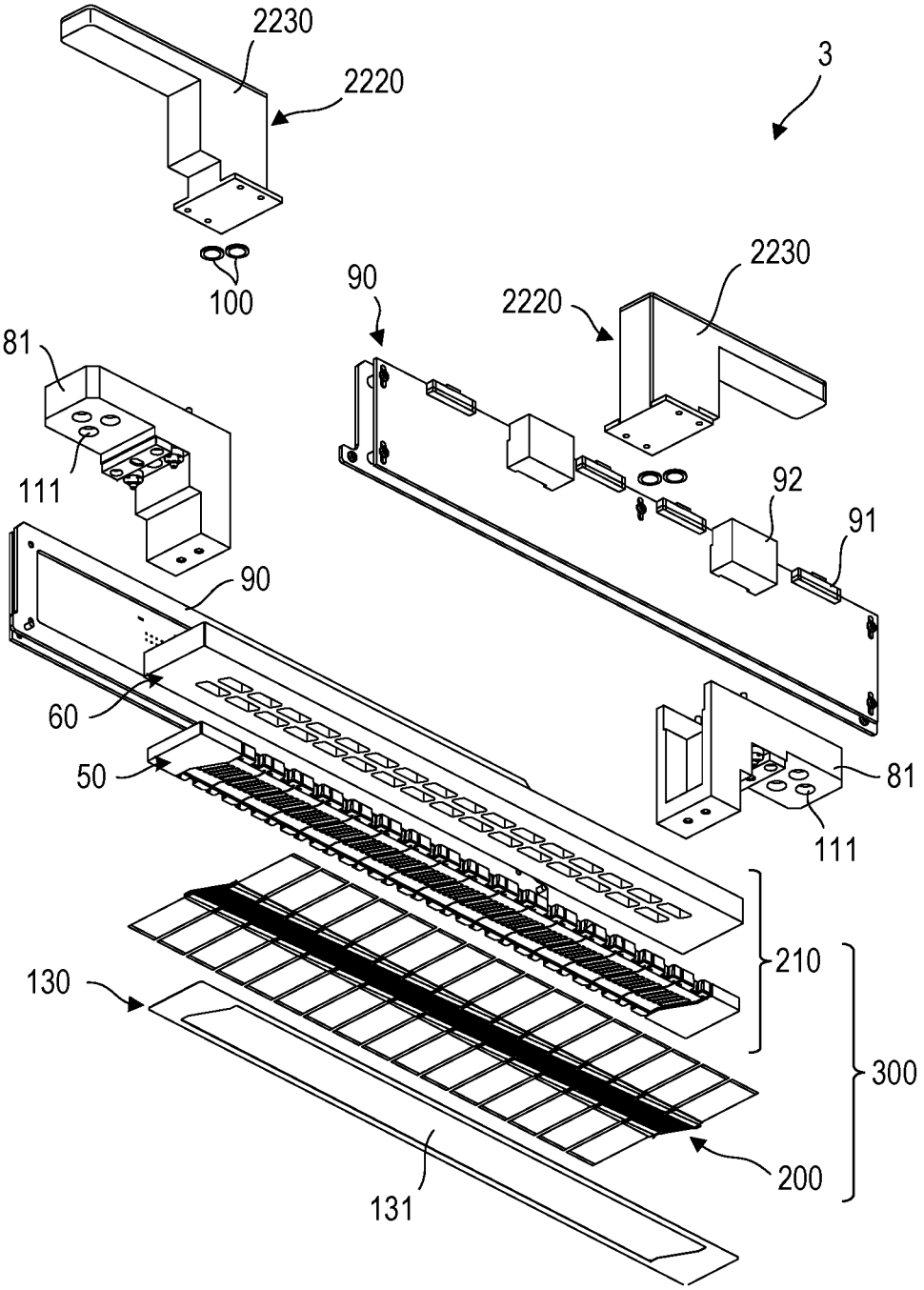
FIG. 6 is an exploded perspective view for illustrating the liquid ejection head.

FIG. 6 is an exploded perspective view of the liquid ejection head 3, in which components or units that form the liquid ejection head 3 are illustrated separately for their functions. In the liquid ejection head 3, a first flow path member 50 and a second flow path member 60 form a flow path forming member 210. A plurality of ejection modules 200 are combined with the flow path forming member 210 to form the liquid ejection unit 300. A cover member 130 is mounted to a surface of the liquid ejection unit 300 on the recording medium side. The cover member 130 has a frame-shaped front surface with an opening 131 having an elongated shape. The opening 131 is formed to expose the recording element boards 10 included in the ejection modules 200 and a sealing member therefor. A frame portion around the opening 131 has a function as an abutment surface of a cap member configured to cover a surface of the liquid ejection head 3, which has the ejection orifices, when the liquid ejection head 3 is in a recording standby state. Thus, it is preferred that, when the surface of the liquid ejection head 3 is covered, a closed space be defined by applying, for example, an adhesive, a sealing member, and a filler along an edge of the opening 131 to eliminate unevenness on or fill a gap in the surface of the liquid ejection unit 300, in which the ejection orifices are formed.

Further, the liquid ejection head 3 includes two liquid ejection unit supporting portions 81 and two electrical wiring boards 90. In the liquid ejection head 3, stiffness of the liquid ejection head is ensured mainly by the second flow path member 60. The liquid ejection unit supporting portions 81 are connected to both end portions of the second flow path member 60. The liquid ejection unit supporting portions 81 are mechanically coupled to a carriage for the liquid ejection apparatus 2000 to thereby position the liquid ejection head 3. Each of the liquid supply units 2220 includes the pressure control unit 2230. The liquid supply units 2220 are coupled to the liquid ejection unit supporting portions 81 while sandwiching the liquid connection portions 100, each made of a joint rubber, respectively. The electrical wiring boards 90 are also coupled to the liquid ejection unit supporting portions 81, respectively. The filters 221 (see FIG. 12) are built in the two liquid supply unit 2220, respectively.

The two pressure control units 2230 are set so as to control relatively high and low pressures, which are different from each other, respectively. Specifically, as illustrated in, for example, FIG. 12 referred to later, the pressure adjustment mechanism provided to one of the pressure control units 2230 is for a high pressure, and the pressure adjustment mechanism provided to another one of the pressure control units 2230 is for a low pressure. Details of the pressure control units 2230 are described later. When the pressure control unit 2230 on the high pressure side and the pressure control unit 2230 on the low pressure side are installed at both end portions of the liquid ejection head 3 as described above, directions of flows of the liquid in the common supply flow path 211 and the common collection flow path 212, which extend in the longitudinal direction of the liquid ejection head 3, are opposite to each other to thereby cause a countercurrent flow. In such a configuration, heat exchange between the common supply flow path 211 and the common collection flow path 212 is promoted. As a result, a temperature difference between the two common flow paths is reduced. In this manner, a temperature difference among the plurality of recording element boards 10 provided along the common flow paths is reduced. Thus, there arises an advantage that recording unevenness due to a temperature difference is less liable to be caused.

Next, details of the flow path forming member 210 of the liquid ejection unit 300 are described. As illustrated in FIG. 6, the flow path forming member 210 includes the first flow path member 50 and the second flow path member 60, which are stacked one another. The flow path forming member 210 is configured to distribute the liquid supplied from the liquid supply units 2220 to the ejection modules 200. Further, the flow path forming member 210 functions as a flow path member configured to return the recording liquid circulated from the ejection modules 200 to the liquid supply units 2220. The second flow path member 60 includes the common supply flow path 211 and the common collection flow path 212 formed therein, and has a function of mainly ensuring the stiffness of the liquid ejection head 3. Thus, it is preferred that a material of the second flow path member 60 have sufficient corrosion resistance to the liquid and high mechanical strength. Specifically, for example, stainless steel, titanium, or alumina can be preferably used.

Figure 7A:
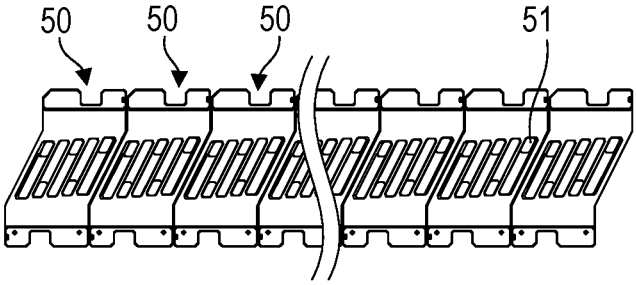
FIG. 7A, FIG. 7B, FIG. 7C, FIG. 7D, and FIG. 7E are views for illustrating configurations of flow path members on a front surface side and a back surface side.
Figure 7B:
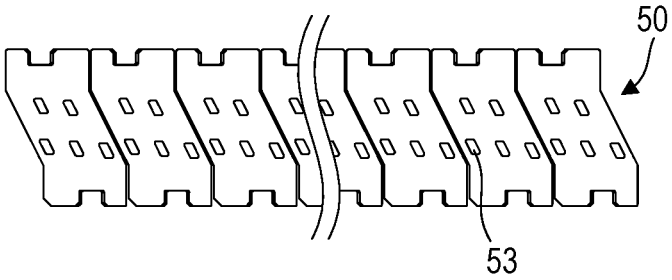
Figure 7C:
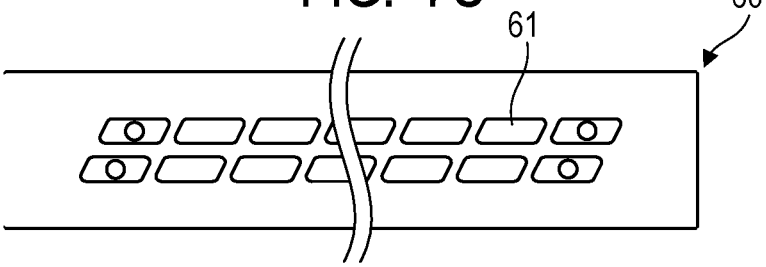
Figure 7D:
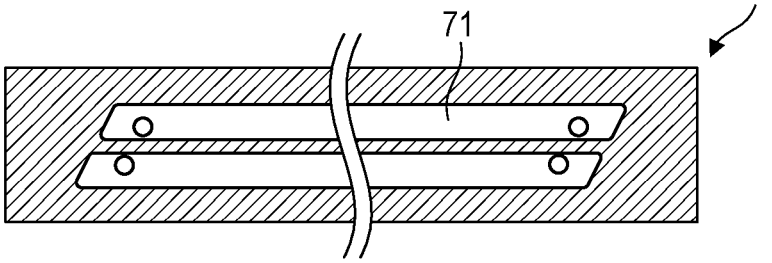
Figure 7E:
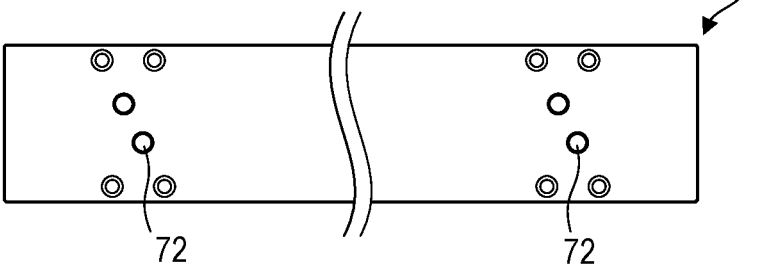

Next, with reference to FIG. 7A to FIG. 7E, details of the first flow path member 50 and the second flow path member 60 are described. FIG. 7A is a view for illustrating a surface of the first flow path member 50, on which the ejection modules 200 are to be mounted. FIG. 7B is a view for illustrating a back surface of the first flow path member 50, which is to be brought into contact with the second flow path member 60. The first flow path member 50 includes a plurality of members, which are arranged adjacent to each other so as to correspond to the ejection modules 200, respectively. When the divided structure described above is employed and the plurality of the above-mentioned ejection modules are arranged, a length required for the liquid ejection head 3 can be achieved. This configuration is particularly suitably appliable to a liquid ejection head having a relatively large length corresponding to, for example, a B2 size under Japanese Industry Standards (JIS) or a larger size. As illustrated in FIG. 7A, communication ports 51 of the first flow path member 50 fluidically communicate with the ejection modules 200. As illustrated in FIG. 7B, individual communication ports 53 of the first flow path member 50 fluidically communicate with communication ports 61 of the second flow path member 60. FIG. 7C is a view for illustrating a surface of the second flow path member 60, which is to be brought into contact with the first flow path member 50. FIG. 7D is a sectional view for illustrating a central portion of the second flow path member 60 in a thickness direction thereof, and FIG. 7E is a view for illustrating a surface of the second flow path member 60, which is to be brought into contact with the liquid supply units 2220. Communication ports 72 illustrated in FIG. 7E communicate with the pressure control units 2230 through intermediation of the liquid connection portions 100 illustrated in FIG. 6. The recording liquid is supplied from the communication ports 72 on one side to the second flow path member 60, and is discharged from the communication ports 72 on another side. One of common flow path grooves 71 of the second flow path member 60 is the common supply flow path 211 illustrated in FIG. 8, and another one thereof is the common collection flow path 212. Each of the common flow path grooves 71 is configured to supply the liquid from one end to another end along the longitudinal direction of the liquid ejection head 3. As described above, a direction of flow of the liquid in the common supply flow path 211 and that in the common collection flow path 212 are opposite to each other along the longitudinal direction of the liquid ejection head 3.

Figure 8:
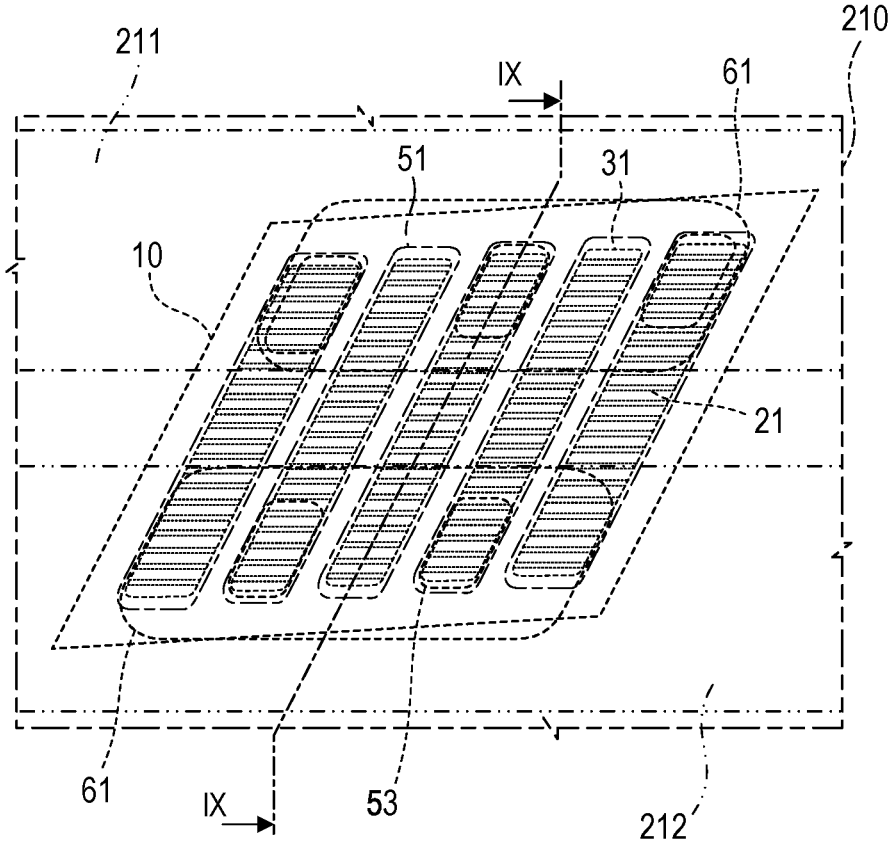
FIG. 8 is a transparent view for illustrating a connection relationship among flow paths.

FIG. 8 is a transparent view for illustrating a connection relationship among the flow paths in the recording element board 10 and the flow path forming member 210. As illustrated in FIG. 8, the flow path forming member 210 has a set of the common supply flow path 211 and the common collection flow path 212, each extending in the longitudinal direction of the liquid ejection head 3. The communication ports 61 of the second flow path member 60 are connected to the individual communication ports 53 of the first flow path member 50 so that, when the second flow path member 60 and the first flow path member 50 are placed to overlap with each other, the individual communication ports 53 are located inside the communication ports 61 in plan view. As a result, liquid supply paths, which extend from the communication ports 72 of the second flow path member 60 through the common supply flow path 211 and communicate with the communication ports 51 of the first flow path member 50, are formed. Similarly, liquid supply paths, which extend from the communication ports 72 of the second flow path member 60 through the common collection flow path 212 and communicate with the communication ports 51 of the first flow path member 50, are also formed.

Figure 9:
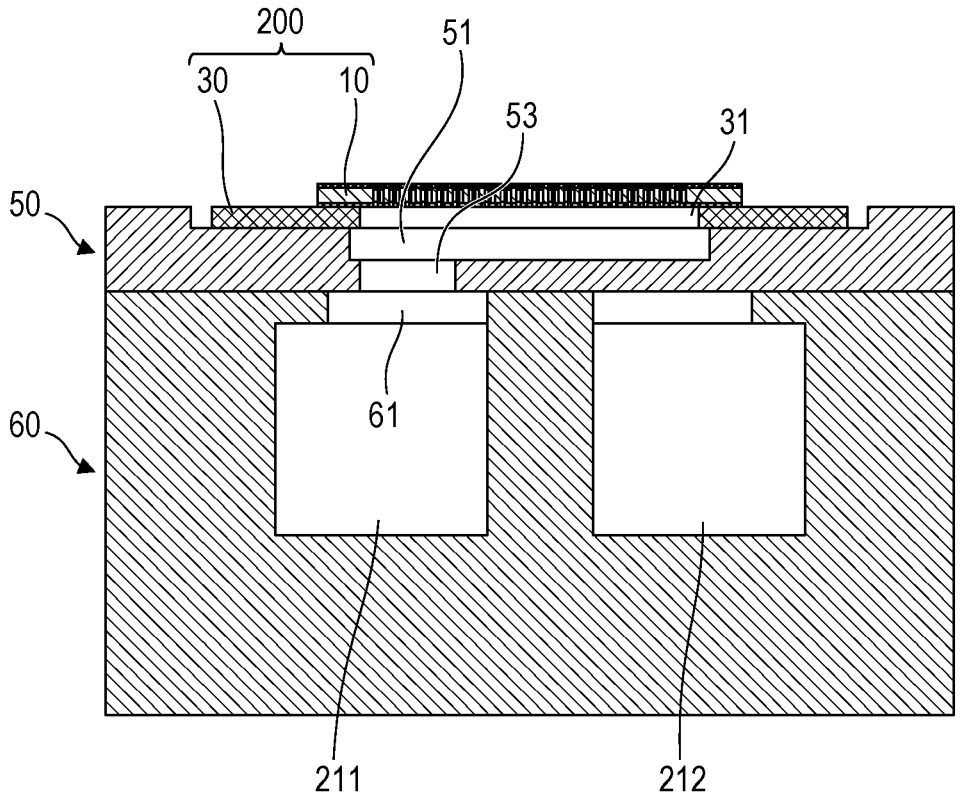
FIG. 9 is a sectional view for illustrating a flow path forming member and an ejection module.

FIG. 9 is a sectional view taken along the line IX-IX in FIG. 8. As illustrated in FIG. 9, the common supply flow path 211 is connected to the ejection module 200 through the communication ports 61, the individual communication ports 53, and the communication ports 51. Although not shown in FIG. 9, it is apparent with reference to FIG. 8 that, in another cross section, the common collection flow path 212 is connected to the ejection module 200 through a similar flow path. A flow path that communicates with a pressure chamber is formed at a position at which each of the ejection orifices 13 (see FIG. 11A) is formed in each of the ejection modules 200 and the recording element boards 10. Part or all of the supplied liquid can be circulated through the pressure chamber corresponding to the ejection orifices 13, which are in a discharge-operation stop state, through the flow path. The common supply flow path 211 is connected to the pressure control unit 2230 on the high pressure side through a corresponding one of the liquid supply units 2220, and the common collection flow path 212 is connected to the pressure control unit 2230 on the low pressure side through another one of the liquid supply units 2220. Thus, flow from the common supply flow path 211 through the pressure chambers of the recording element boards 10 toward the common collection flow path 212 is generated due to a pressure difference generated between the pressure control units 2230.

(Ejection Module)

Figure 10A:
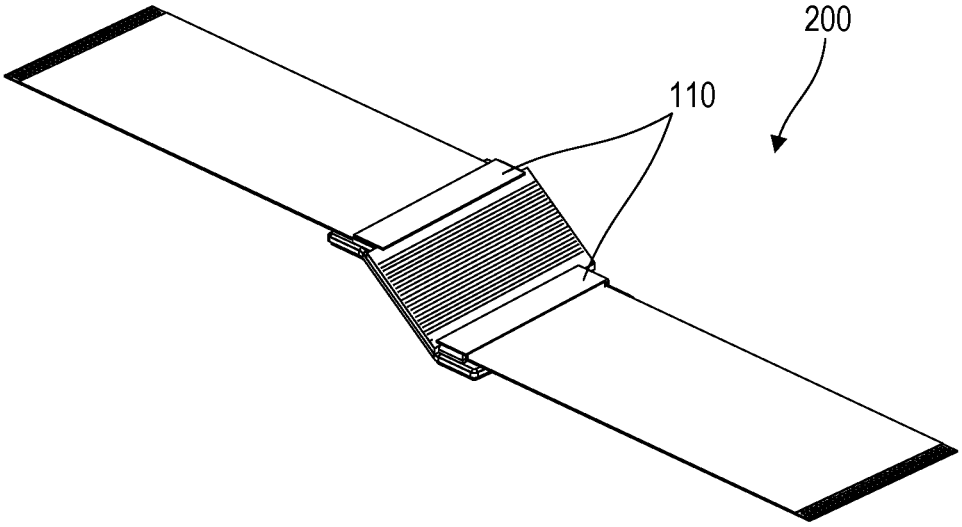
FIG. 10A and FIG. 10B are views for illustrating the ejection module.
Figure 10B:
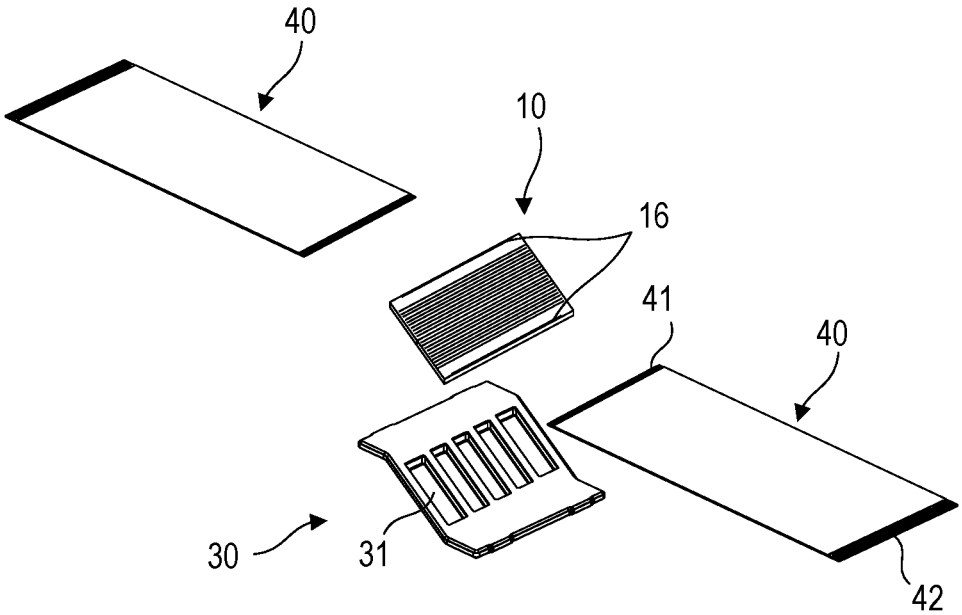

FIG. 10A is a perspective view for illustrating one ejection module 200. FIG. 10B is an exploded view of the ejection module 200. In the ejection module 200, the recording element board 10 is placed on a support member 30. A plurality of terminals 16 (see FIG. 11A) are arranged on each of side portions extending along a direction of rows of the ejection orifices of the recording element board 10, that is, on each of long side portions of the recording element board 10. With this arrangement of the terminals 16, two flexible wiring boards 40, which are electrically connected to the recording element board 10, are arranged for one recording element board 10. This arrangement is employed for the following reason. The number of rows of the ejection orifices formed in one recording element board 10 is, for example, twenty. A maximum distance from the terminals 16 to the recording element is reduced so as to reduce a reduction in voltage or a signal delay, which occurs in the wiring portion of the recording element board 10. The support member 30 is a support body configured to support the recording element board 10, and at the same time, is a flow path communication member configured to bring the recording element board 10 and the flow path forming member 210 into fluidic communication with each other. Liquid communication ports 31 of the support member 30 are formed so as to traverse all the rows of the ejection orifices formed in the recording element board 10.

(Structure of Recording Element Board)

Figure 11A:
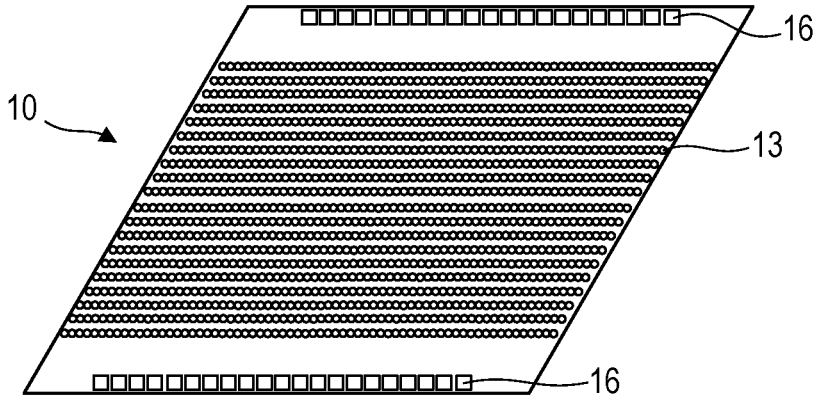
FIG. 11A, FIG. 11B, and FIG. 11C are views for illustrating a configuration of a recording element board.
Figure 11B:
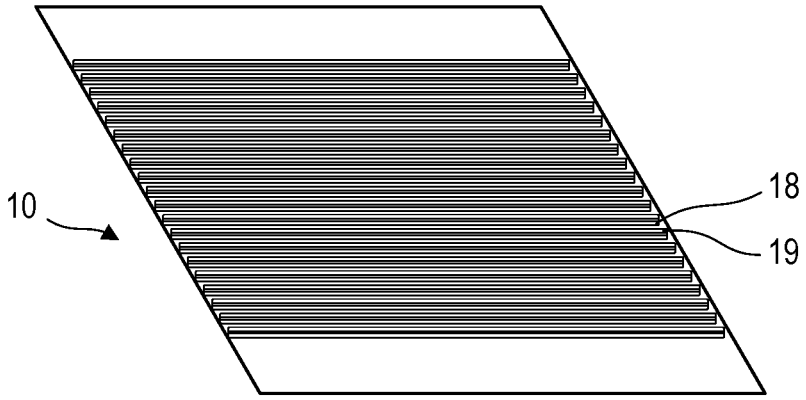
Figure 11C:
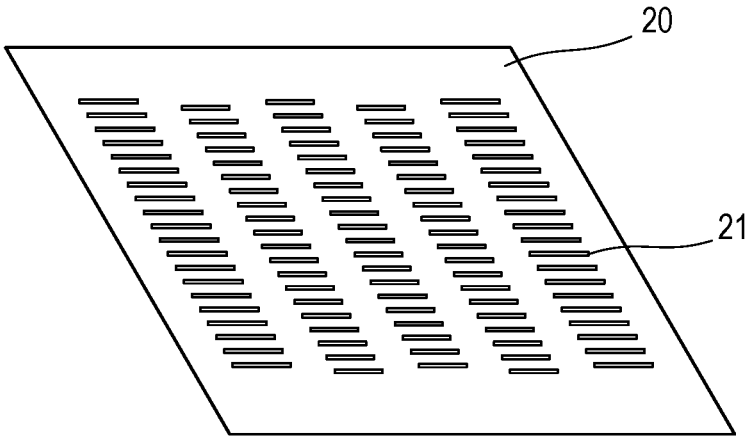

A configuration of the recording element board 10 is described with reference to FIG. 11A to FIG. 11C. FIG. 11A is a schematic view of a surface of the recording element board 10, in which the ejection orifices 13 are formed. FIG. 11B is a view for illustrating a portion having liquid supply paths 18 and liquid collecting paths 19. FIG. 11C is a plan view of a side corresponding to a back surface with respect to the surface illustrated in FIG. 11A. FIG. 11B is a view for illustrating a state in which a lid member 20 provided to the back surface side of the recording element board 10 in FIG. 11C is removed. Energy generating elements are provided below the ejection orifices 13 of the recording element board 10. When energy is given to the recording liquid by the energy generating elements, the recording liquid is ejected from the ejection orifices 13 to perform recording. As illustrated in FIG. 11B, the liquid supply paths 18 and the liquid collecting paths 19 are alternately formed in the back surface of the recording element board 10 along the direction of the rows of the ejection orifices. The terminals 16 are provided to both side portions extending along the direction of the rows of the ejection orifices of the recording element board 10. One set of the liquid supply path 18 and the liquid collecting path 19 is formed for each row of the ejection orifices. The lid member 20 has openings 21 communicating with the liquid communication ports 31 of the support member 30.

(Third Circulation Mode)

Figure 12:
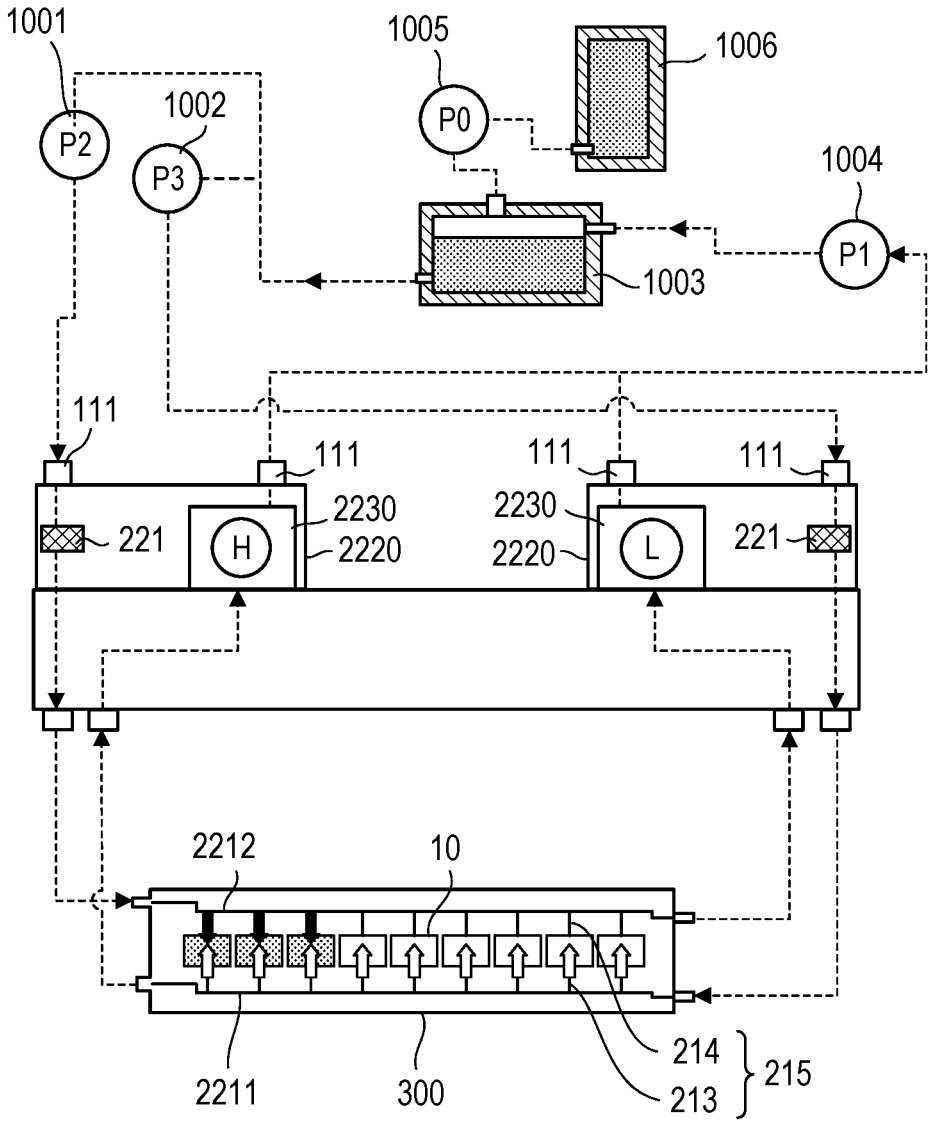
FIG. 12 is a view for illustrating a third circulation mode.

Next, a third circulation mode, which is a circulation mode of the liquid ejection apparatus 2000 described with reference to FIG. 5A to FIG. 11C, is described with reference to FIG. 12. In the liquid ejection head 3 of the liquid ejection apparatus 2000 described with reference to FIG. 5A to FIG. 11C, the direction of flow of the recording liquid in the common supply flow path 211 and the direction of flow of the recording liquid in the common collection flow path 212 are opposed to each other. The third circulation mode illustrated in FIG. 12 is based on the second circulation mode illustrated in FIG. 3 with a slight change in, for example, arrangement of the pressure control units 2230 in accordance with a difference in direction of flow of the recording liquid. A basic operation in the third circulation mode is the same as that in the second circulation mode. The liquid ejection head 3 includes the pressure control units 2230 on the high pressure side (H) and the low pressure side (L), which are provided to both end portions of the liquid ejection head 3 in the longitudinal direction. One pressure adjustment mechanism is provided to each of the pressure control units 2230. The recording liquid passes through the common supply flow path 211 or the common collection flow path 212 to flow into the pressure control units 2230, and is guided to the second circulation pump 1004 via the liquid connection portions 111.

(Back-Pressure Type Pressure Adjustment Mechanism)

Figure 13A:
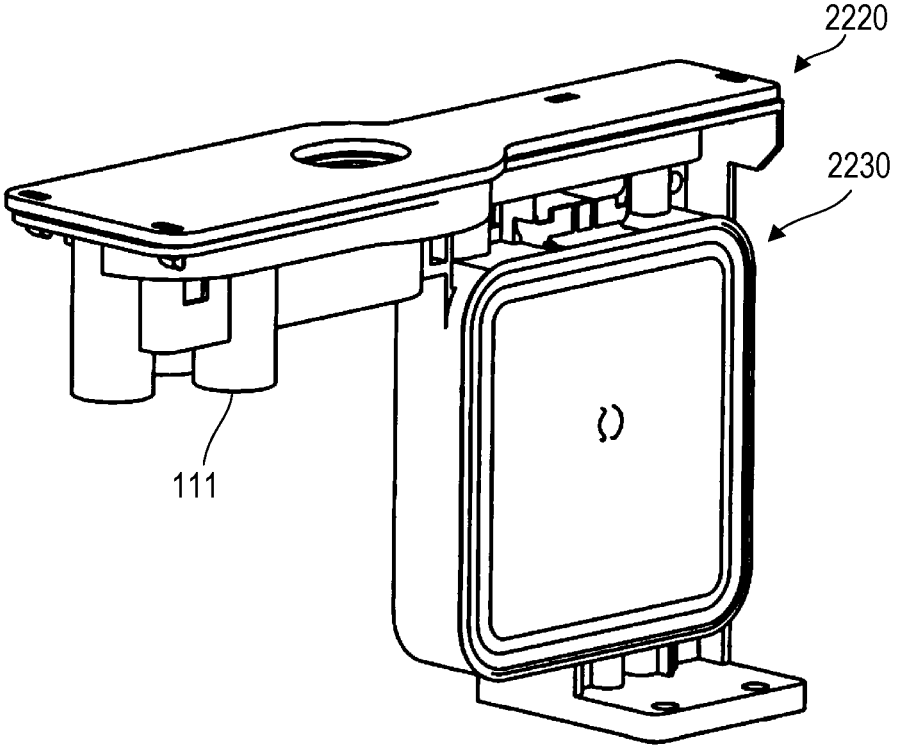
FIG. 13A and FIG. 13B are views for illustrating a back-pressure type pressure adjustment mechanism.
Figure 13B:
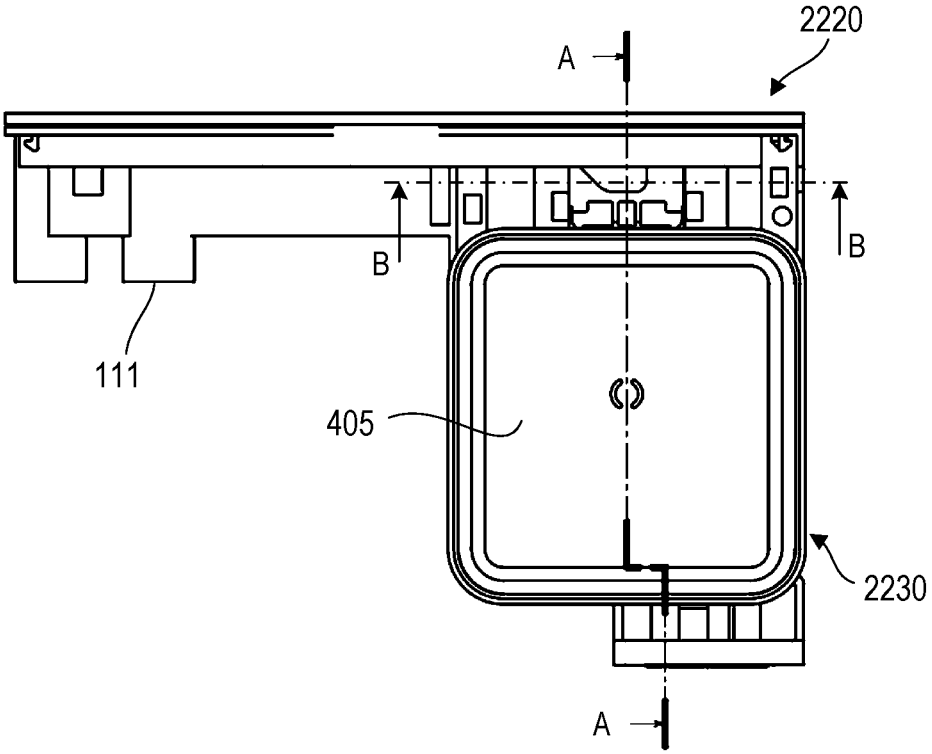
Figure 14A:
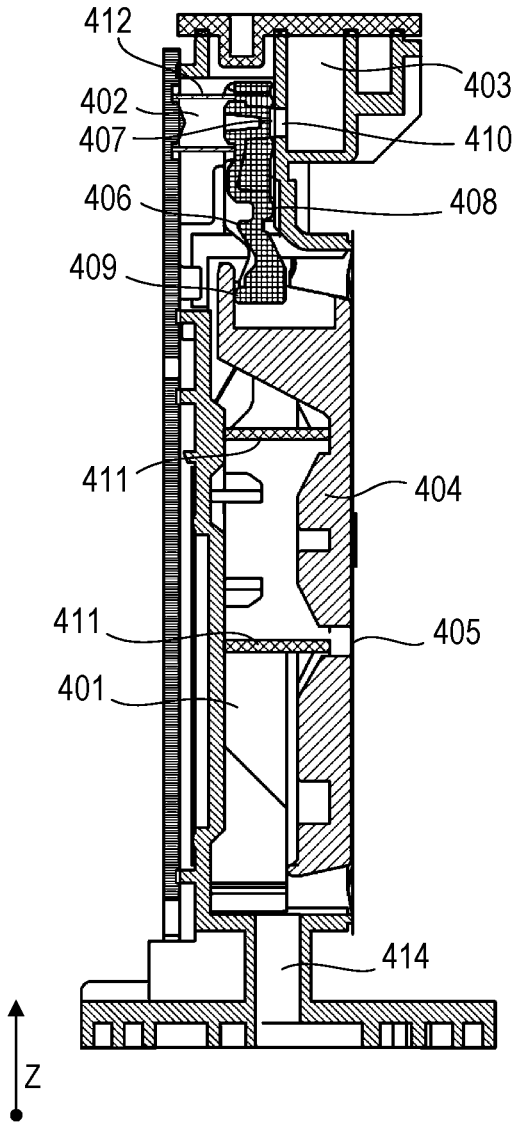
FIG. 14A and FIG. 14B are sectional views of the pressure adjustment mechanism illustrated in FIG. 13A and FIG. 13B.
Figure 14B:
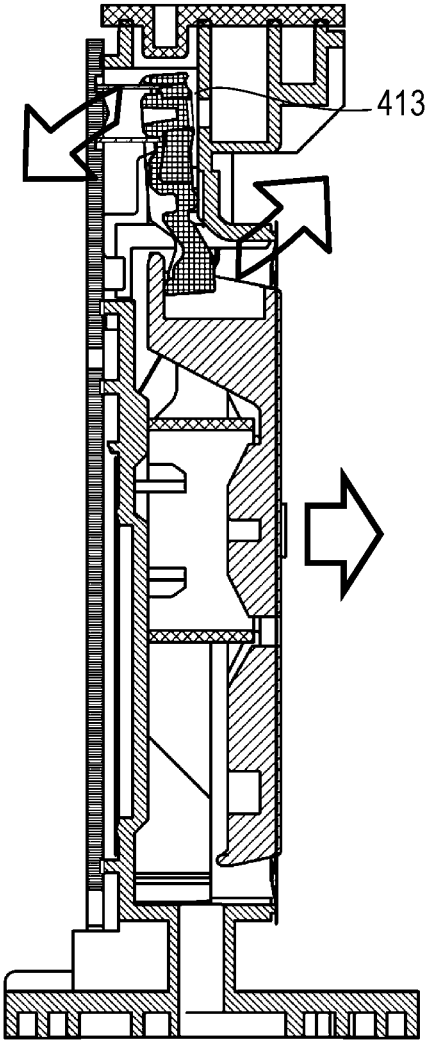

Next, a pressure adjustment mechanism according to one embodiment of the present invention is described. In FIG. 13A, FIG. 13B, FIG. 14A, and FIG. 14B, the pressure adjustment mechanism according to one embodiment is illustrated. The pressure adjustment mechanism is of back pressure type, and is preferably used as a pressure adjustment mechanism to be provided to the pressure control unit 2230 in the liquid ejection apparatus 2000 described with reference to FIG. 5A to FIG. 11C. The pressure adjustment mechanism suits particularly to the second circulation mode and the third circulation mode described above. FIG. 13A and FIG. 13B are a perspective view and a front view of an exterior of the pressure adjustment mechanism, respectively. FIG. 14A is a sectional view of the pressure adjustment mechanism taken along the line A-A in FIG. 13B. FIG. 14B is a sectional view for illustrating an operation of the pressure adjustment mechanism. In FIG. 13A and FIG. 13B, the pressure adjustment mechanism is illustrated under a state in which the pressure control unit 2230 including the pressure adjustment mechanism is mounted to the liquid supply unit 2220 of the liquid ejection apparatus 2000.

The pressure adjustment mechanism has a casing having a flat and substantially rectangular parallelepiped shape. The pressure adjustment mechanism includes a flexible film 405 that is arranged so as to cover one open surface of the casing. The remaining five surfaces of the casing and the flexible film 405 form a first liquid storage chamber 401. The first liquid storage chamber 401 can store a liquid such as the recording liquid inside, and has a variable volume. The first liquid storage chamber 401 corresponds to a first pressure chamber defined in the back pressure-type pressure adjustment mechanism. At least a part of an outer wall of the first liquid storage chamber 401 is formed of the flexible film 405. A pressing plate 404 is a member functioning as a pressure-receiving plate in the back pressure-type pressure adjustment mechanism. The pressing plate 404 is fixed to an inner surface (first liquid storage chamber 401 side) of the flexible film 405, and presses the flexible film 405 in a direction of expanding the first liquid storage chamber 401. A negative-pressure spring 411 is provided as a first urging member between the pressing plate 404 and the casing. The negative-pressure spring 411 is configured to urge the pressing plate 404 in a direction of outwardly expanding the first liquid storage chamber 401. Specifically, the negative-pressure spring 411 urges the pressing plate 404. The pressing plate 404, which is urged, presses the flexible film 405 in a direction of increasing the volume of the first liquid storage chamber 401.

In FIG. 14A, an arrow Z indicates a vertically upward direction. An inflow port 414 configured to allow the liquid to flow into the first liquid storage chamber 401 is formed below the first liquid storage chamber 401 in the vertical direction. When the pressure adjustment mechanism is used in the liquid ejection apparatus 2000, the inflow port 414 communicates with the common supply flow path 211 or the common collection flow path 212. The vertical direction in this embodiment corresponds to a vertical direction when the pressure adjustment mechanism is in use (when the pressure control unit 2230 including the pressure adjustment mechanism is mounted to the liquid ejection apparatus 2000 so as to perform pressure control of the liquid).

A valve chamber 402 is located above the first liquid storage chamber 401 in the vertical direction. The valve chamber 402 communicates with the first liquid storage chamber 401, and forms part of the first liquid storage chamber 401. The valve chamber 402 has an outflow port 410 as an opening. The outlet port 410 is configured to cause the liquid in the first liquid storage chamber 401 to flow to an outside. A second liquid storage chamber 403, which is different from the first liquid storage chamber 401, is formed adjacent to the outlet port 410 on a downstream side thereof. Thus, the outlet port 410 is formed between the first liquid storage chamber 401 and the second liquid storage chamber 403. When the pressure adjustment mechanism is provided to the liquid ejection apparatus 2000, the second liquid storage chamber 403 is connected to the second circulation pump 1004 through intermediation of the liquid connection portions 111 (see FIG. 13A and FIG. 13B). In the pressure control unit 2230 including the pressure adjustment mechanism, the first liquid storage chamber 401 is formed on an upstream side of flow of the liquid, which correspond to a side to which the liquid ejection head 3 is connected. The second liquid storage chamber 403 is located on a downstream side of the flow when viewed from the first liquid storage chamber 401. Thus, the liquid, which has flowed from the common supply flow path 211 or the common collection flow path 212 via the inflow port 414 into the first liquid storage chamber 401, flows into the valve chamber 402 in the first liquid storage chamber 401. Then, the liquid flows into the second liquid storage chamber 403 via the outflow port 410. After that, the liquid is guided to the second circulation pump 1004 through the liquid connection portions 111.

As illustrated in FIG. 14A, it is preferred that the outflow port 410 be formed at a position above the flexible film 405, which is provided as a part of the outer wall of the first liquid storage chamber 401, in the vertical direction. When the valve chamber 402 and the outflow port 410, which are to be arranged on the downstream side of the flow with respect to the first liquid storage chamber 401, are formed in an upper part in the vertical direction as described above, air in the first liquid storage chamber 401 can easily be discharged before the liquid is supplied to the first liquid storage chamber 401. When the air has been sufficiently discharged before the supply of the liquid, a change in water head pressure in the first liquid storage chamber 401, which may be caused by a change in amount of air in the first liquid storage chamber 401, for example, at a time of use of the pressure adjustment mechanism, can be suppressed. Further, with the configuration described above, a change in pump pressure, which may be caused by inflow of the air discharged from the first liquid storage chamber 401 into the second circulation pump 1004 during use of the pressure adjustment mechanism, can be suppressed. Still further, with the configuration described above, when air flows into the first liquid storage chamber 401, the air is less liable to be stagnant in the vicinity of the portion of the first liquid storage chamber 401, which is formed of the flexible film 405. The air is stagnant in the valve chamber 402 or is more likely to be discharged from the outflow port 410. In general, a member having a small thickness such as the flexible film 405 has high gas permeability. When air remains in the vicinity of the portion formed of the flexible film 405, a volume of the remaining air tends to increase due to gas permeation. When the volume of the remaining air increases, the pump pressure may change due to a change in water head pressure in the first liquid storage chamber 401 or inflow of the air into the second circulation pump 1004. Thus, it is preferred that the outflow port 410 be formed above the portion formed of the flexible film 405 in the vertical direction so that the remaining air is less liable to be stagnant in the vicinity of an inner side of the portion of the outer wall, which is formed of the flexible film 405.

Figure 15A:
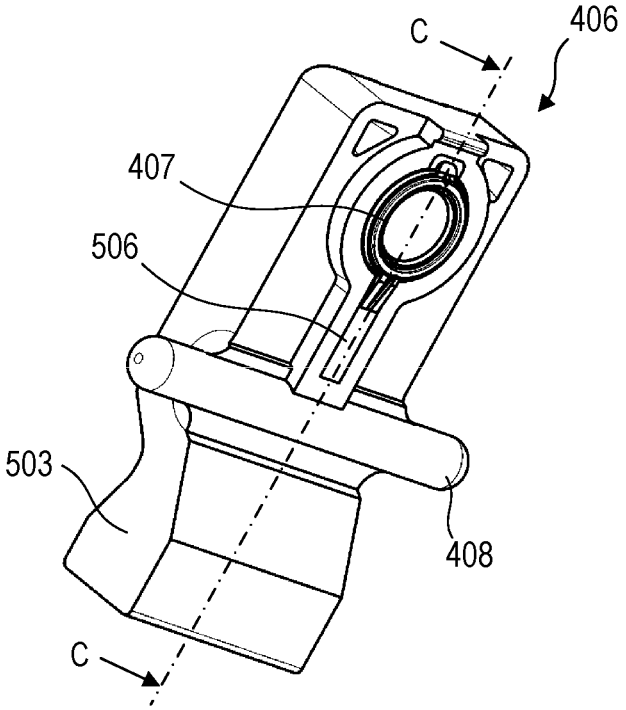
FIG. 15A and FIG. 15B are perspective views for illustrating a valve, which is an example of a sealing member according to the present invention.
Figure 15B:
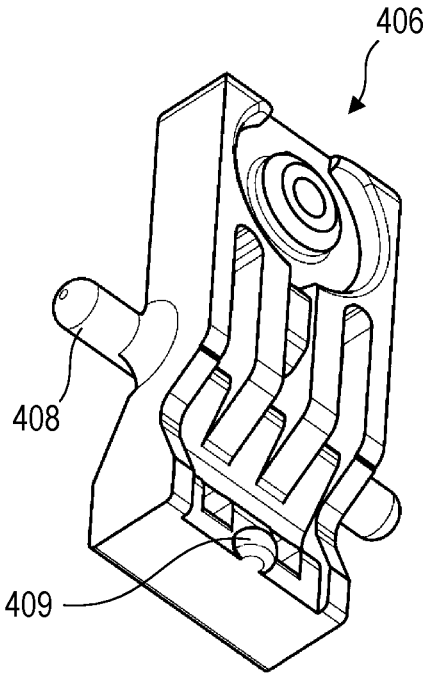

Next, a valve 406 to be arranged in the valve chamber 402 is described. The valve 406 is formed of a sealing member according to the present invention. FIG. 15A and FIG. 15B are enlarged views of the valve 406 when the valve 406 is viewed at different angles, respectively. The valve 406 is formed to have a lever shape as described later as a lever portion 503. The valve 406 is turnable about a shaft 408 fitted into a bearing (not shown) of the pressure adjustment mechanism. A valve portion 407 acting as a valve body of the valve 406 is provided at one end portion of the valve 406. When a gap 413 (see FIG. 14B), which is variable, is defined between the valve portion 407 and the outflow port 410, variable flow resistance can be applied to the liquid flowing from the valve chamber 402 via the outflow port 410, which is an opening, into the second liquid storage chamber 403. A magnitude of the gap 413, which is a distance between the valve portion 407 and the outflow port 410, corresponds to a valve opening degree. When the gap 413 is large, the valve opening degree is large and the flow resistance is small. Further, a valve spring 412 is arranged as a second urging member in the valve chamber 402. The valve spring 412 urges the valve portion 407 in a direction of decreasing the gap 413 between the valve portion 407 and the outflow port 410, that is, in a direction of closing the outflow port 410 with the valve portion 407.

Meanwhile, a pressing-plate contact portion 409 is formed at another end portion of the valve 406, which is located on a side opposite to the valve portion 407 across the shaft 408. The pressing-plate contact portion 409 is configured to transmit movement of the flexible film 405 and the pressing plate 404 in the first liquid storage chamber 401 to the valve 406. When the flexible film 405 and the pressing plate 404 are moved, that is, are displaced in accordance with the volume of the first liquid storage chamber 401, the valve 406 is moved in a turning manner in association with the movement of the pressing plate 404 through contact of part of the pressing plate 404 with the pressing-plate contact portion 409. In FIG. 14B, turning of the valve 406 in a direction of increasing the gap 413 between the valve portion 407 of the valve 406 and the outflow port 410, that is, a direction of increasing the valve opening degree at the outflow port 410 is indicated by arrows.

When the pressing plate 404 is moved in a direction of increasing the volume of the first liquid storage chamber 401, the pressing-plate contact portion 409, which is in contact with the pressing plate 404, is moved in a turning manner about the shaft 408. Through this movement, the valve portion 407 is moved away from the outflow port 410 to increase the gap 413 between the valve portion 407 and the outflow port 410. As a result, the valve opening degree of the outflow port 410 is increased. Specifically, when the pressing plate 404 is displaced in the direction of expanding the first liquid storage chamber 401, the valve portion 407, which is an elastic member, is moved away from the outflow port 410. As a result, the flow resistance to the liquid flowing out via the outflow port 410 decreases. On the contrary, when the pressing plate 404 is moved in the direction of decreasing the volume of the first liquid storage chamber 401, the pressing-plate contact portion 409, which is in contact with the pressing plate 404, is moved in a turning manner about the shaft 408 of the valve 406. Through this movement, the gap 413 between the valve portion 407 and the outflow port 410 decreases to reduce the valve opening degree of the outflow port 410. As a result, the flow resistance increases. As described above, through the movement of the flexible film 405 and the pressing plate 404, the valve 406 is moved to change the gap 413 between the valve portion 407 and the outflow port 410, that is, the valve opening degree at the outflow port 410.

As described above, the valve opening degree at the outflow port 410 and the flow resistance to the liquid at the outflow port 410 change depending on the movement of the valve 406. The valve 406 is moved through the contact of the pressing-plate contact portion 409 with the pressing plate 404. A range of movement (movable range) of the valve 406 is limited by the shaft 408 and the bearing fitted over the shaft 408. As a result, a turning operation of the valve 406, which is movement limited by the shaft 408 and the bearing, is performed. Specifically, the valve 406 is moved so as to increase the valve opening degree in association with the expansion of the first liquid storage chamber 401. However, the range of movement is limited to a preset range. Thus, even under the effects of the flexible film 405 or the pressing plate 404, the gap 413 between the valve portion 407 and the outflow port 410, which corresponds to the valve opening degree of the outflow port 410, can be set to a desired value.

Meanwhile, the following case is considered. Specifically, a liquid storage chamber (pressure chamber) is defined by the flexible film 405 and the pressing plate 404. A valve is formed integrally with the flexible film 405 and the pressing plate 404. A movable range of the valve is not limited by members other than the pressing plate 404. In this case, the movement of the valve is susceptible to effects of stiffness of the flexible film 405 itself or effects of a crease or a wrinkle in the flexible film 405. For example, the pressing plate 404 is moved in an inclined state due to effects of a wrinkle in the flexible film 405 to prevent achievement of a desired value of the valve opening degree of the outflow port 410. Meanwhile, in this embodiment, the movable range of the valve 406 is limited by members other than the pressing plate 404. Thus, the valve opening degree at the outflow port 410 can be set to a predetermined value regardless of states of the flexible film 405 and the pressing plate 404. Thus, in this embodiment, the effects of the flexible film 405 on control of the pressure of the liquid, which is performed by the valve 406, are reduced. Thus, stable pressure control can be performed.

Figure 16A:
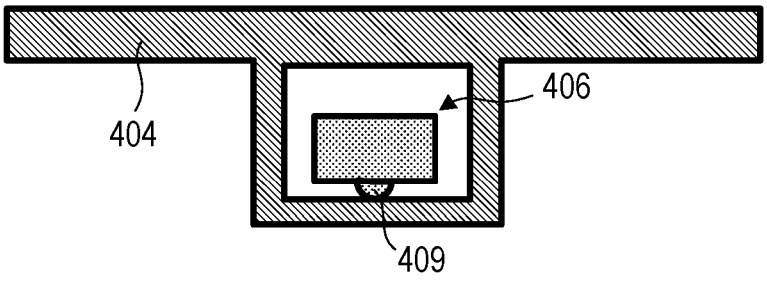
FIG. 16A and FIG. 16B are schematic sectional views for illustrating an inclination of a pressing plate.
Figure 16B:
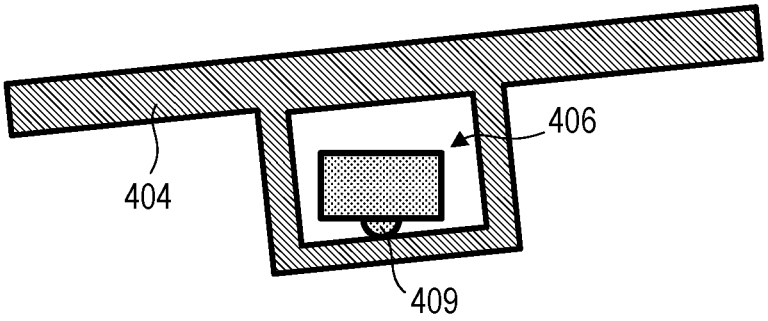

As illustrated in FIG. 15A and FIG. 15B, it is preferred that the pressing-plate contact portion 409 formed on the valve 406 be formed to have a shape of at least a part of a sphere. In FIG. 15A and FIG. 15B, the pressing-plate contact portion 409 having a semi-spherical shape is illustrated. FIG. 16A and FIG. 16B are views for illustrating an example of an inclination of the pressing plate 404. In FIG. 16A, a state without inclination is illustrated. In FIG. 16B, a state in which the pressing plate 404 is moved so as to be inclined from the state illustrated in FIG. 16A is illustrated. The pressing-plate contact portion 409 is formed to have an at least partially spherical shape. As a result, even when the pressing plate 404 is displaced in the inclined state as illustrated in FIG. 16B, the pressing plate 404 and the pressing-plate contact portion 409 are in contact with each other at one point on a spherical surface. Thus, a load point of the valve 406 is fixed, and hence the valve 406 can stably operate.

Next, stabilization of the pressure in the first liquid storage chamber 401, that is, the back pressure in the pressure adjustment mechanism is described. The pressure in the first liquid storage chamber 401 is determined by the following relational expressions.

$$(F1+P1\cdot S1)L1=(F2-(P2-P1)S2)L2 \quad (1)$$

$$(P1-P2)=R\cdot Q \quad (2)$$

In the expressions, parameters represent the following values.

P1: pressure (gauge pressure) in the first liquid storage chamber 401,

P2: pressure (gauge pressure) in the second liquid storage chamber 403,

F1: spring force of the negative-pressure spring 411,

F2: spring force of the valve spring 412,

S1: pressure-receiving area of the pressing-pressure plate 404,

S2: pressure-receiving area of the valve portion 407,

L1: arm length 1 of the lever portion 503 (length from the shaft 408 to the pressing-plate contact portion 409), L2: arm length 2 of the lever portion 503 (length from the shaft 408 to the valve portion 407), R: flow resistance in the gap 413 between the valve portion 407 and the outflow port 410, Q: flow rate of the liquid.

In this case, for simplification, it is assumed that the pressure in the valve chamber 402 is equal to the pressure in the first liquid storage chamber 401. The flow resistance R in the gap 413 between the valve portion 407 and the outflow port 410 changes depending on the magnitude of the gap 413. As the gap 413 increases, that is, the distance between the valve portion 407 and the outflow port 410 increases, the flow resistance R decreases. Expression (1) expresses an equilibrium of forces in the valve 406, and Expression (2) expresses that a product of the flow resistance and the flow rate is equal to a pressure difference. When the magnitude of the gap 413 is determined so as to simultaneously satisfy Expression (1) and Expression (2) given above, the pressure P1, that is, the back pressure of the pressure adjustment mechanism is derived.

For example, when the flow rate Q of the liquid flowing into the pressure adjustment mechanism in the liquid ejection apparatus 2000 including the pressure adjustment mechanism increases, the following phenomenon occurs. The pressure P2 in the second liquid storage chamber 403 increases due to pressure characteristics in accordance with the flow rate through the second circulation pump 1004 arranged on the downstream side of the pressure adjustment mechanism and an increase in flow resistance in the path from the second liquid storage chamber 403 to the second circulation pump 1004. The pressure P2 is a pressure on a suction side of the second circulation pump 1004. Thus, the pressure P2 becomes closer to a positive pressure. When the pressure P2 increases, the pressure P1 instantaneously drops in accordance with Expression (1). At this time, the flow rate Q and the pressure P2 increase, while the pressure P1 decreases. Thus, the valve 406 is displaced so as to reduce the flow resistance R in accordance with Expression (2). For a reduction in flow resistance R, the gap 413 between the valve portion 407 and the outflow port 410 is required to be increased. Thus, the valve 406 is displaced in a turning manner in a direction of increasing the gap 413. Along with the displacement, the valve spring 12 is displaced in a direction of reducing a spring length. Thus, the spring force F2 increases. Meanwhile, the load spring 411 on the pressing plate 404 side is displaced in a direction of increasing the spring length. Thus, the spring force F1 decreases. At this time, the pressing plate 404 is displaced in a direction of increasing the volume of the first liquid storage chamber 401. As a result, the pressure P1 instantaneously increases in accordance with Expression (1). When the pressure P1 increases, the pressure P2 instantaneously decreases due to an action reverse to that described above. Through repetition of such a phenomenon within a short period of time, Expression (1) and Expression (2) are required to be satisfied at the same time, while the flow resistance R is changing in accordance with the flow rate Q. Thus, the pressure P1, which is a back pressure, is maintained to a pressure falling within a given range.

In the liquid ejection apparatus 2000, the first liquid storage chamber 401 of the pressure adjustment mechanism communicates with the common collection flow path 212 and the liquid ejection unit 300 via the inflow port 414. In this case, when the pressure P1, which is a back pressure, is maintained to a pressure falling within a given range, a pressure of the liquid ejection unit 300 associated with the liquid ejection is maintained to fall within a given range. As described above, the gap 413 between the valve portion 407 and the outflow port 410 is greatly associated with the maintenance of the pressure P1 to a pressure falling within the given range as described above. For example, a case in which a positional relationship is such that the valve portion 407 is relatively significantly inclined with respect to the outflow port 410 is now assumed. In such a case, the gap 413 having such a magnitude as to provide the flow resistance R for satisfying both of Expression (1) and Expression (2) cannot be formed. Thus, the pressure P1 cannot be maintained to fall within the given range.

The valve 406 described above has the valve portion 407 functioning as the valve body provided at one end with respect to the shaft 408 as a center and the pressure-plate contact portion 409 provided at another end. The configuration of the valve 406, which corresponds to the sealing member according to the present invention, is not limited to that described above. For example, a valve, which is displaced in a turning manner about one end portion functioning as a shaft, may be used as the valve 406. Further, a valve configured to change the magnitude of the gap 413 between the valve portion 407 and the outflow port 410 not through turning but through linear displacement may be used. The valve opening degree at the outflow port 410 indicates a degree of ease of flow of the liquid in consideration of the flow resistance at the outflow port 410. When the gap 413 between the valve portion 407 and the outflow port 410 increases, the valve opening degree also increases. Further, even when an opening area of the outflow port 410 itself increases, the valve opening degree increases. Still further, when the outflow port 410, which is in a state of being closed with the valve (at the valve opening degree of 0%), is at least partially opened through the movement of the valve, the valve opening degree also increases.

It is preferred that, in the pressure adjustment mechanism, a direction of movement of the valve 406, in particular, a direction of movement of the valve portion 407 being the valve body be different from a direction of displacement of the flexible film 405. When the direction of displacement of the flexible film 405 and the direction of movement of the valve portion 407 are the same, a restriction on the variable range of the valve 406 with members other than the pressing plate 404 is liable to directly affect the movement of the flexible film 405 and the pressing plate 404. Thus, desired movement of the flexible film 405 or the pressing plate 404 is less likely to be achieved. Meanwhile, when the direction of displacement of the flexible film 405 and the direction of movement of the valve portion 407 are different from each other, the movement of the flexible film 405 or the pressing plate 404 is less liable to be directly affected by the restriction on the movable range of the valve 406 with members other than the pressing plate 404. Thus, desired movement of the flexible film 405 or the pressing plate 404 is more likely to be achieved.

Further, it is preferred that the configuration of the pressure adjustment mechanism be such that the flexible film 405 and the pressing plate 404 are linearly displaced and the valve 406 is moved in a turning manner in association with the linear displacement. When the valve 406 is moved in a turning manner, it is easy to restrict the movable range of the valve 406 with use of a member other than the pressing plate 404, for example, through fixing of the shaft for turning. In particular, when the outflow port 410 is located above the first liquid storage chamber 401 in the vertical direction, it is preferred that the valve 406 be moved in a turning manner. When the valve 406 is moved in a turning manner and the valve opening degree increases, a width of the gap 413 between the valve portion 407 and the outflow port 410 increases in the vertically upward direction. When the gap width increases in the vertically upward direction, air, which is liable to accumulate in an upper part of the valve chamber 402 in the vertical direction, can easily be caused to flow out from the outflow port 410 via the gap 413.

The valve opening degree at the outflow port 410 has been described based on a change in flow resistance depending on the magnitude of the gap 413 in a direction in which the valve portion 407 and the outflow port 410 are opposed to each other. However, a change in flow resistance according to the present invention is not limited to that described above. For example, the flow resistance may also be changed through the displacement of the valve portion 407 to vary the opening area of the outflow port 410 itself. In any case, the movable range of the valve 406, which corresponds to the sealing member according to the present invention, is restricted by members other than the pressing plate 404. As a result, the flexible film 405 is less liable to affect the control of the pressure of the liquid, which is performed by the valve 406.

Figure 17A:
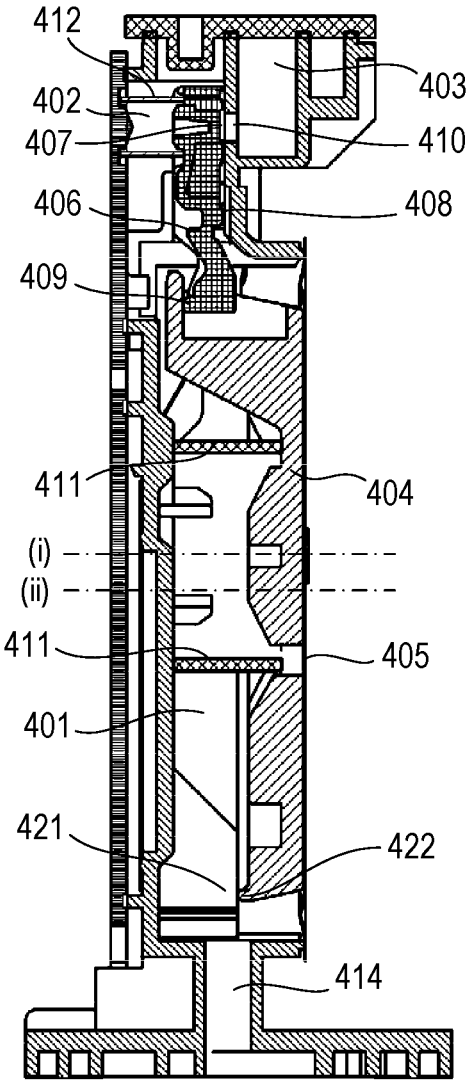
FIG. 17A and FIG. 17B are sectional views for illustrating movement of the pressing plate and the valve.
Figure 17B:
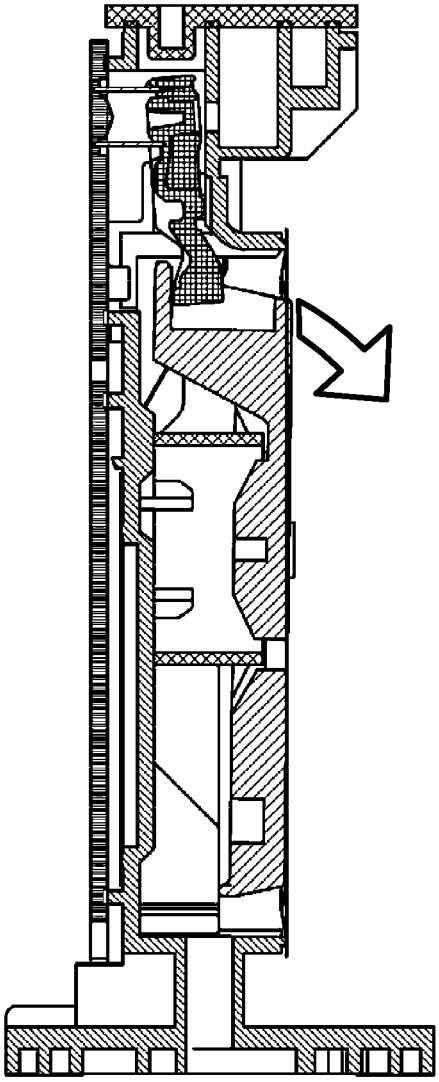

Next, there is described with reference to FIG. 17A and FIG. 17B an example of the movement of the pressing plate 404 and the valve 406, which is different from the example described with reference to FIG. 14A and FIG. 14B. FIG. 17A is a sectional view for illustrating a pressure adjustment mechanism in this example. In the example illustrated in FIG. 17A and FIG. 17B, the pressing plate 404 is moved in a turning manner in a direction of increasing the volume of the first liquid storage chamber 401. In FIG. 17A, an axis located in a center of the negative-pressure spring 411, which is the urging member, is illustrated as an axis (i), and an axis passing through centers of the flexible film 405 and the pressing plate 404 in the vertical direction is illustrated as an axis (ii). The flexible film 405 and the pressing plate 404 form a movable portion in the first liquid storage chamber 401. Both of the axis (i) and the axis (ii) are axes orthogonal to the vertical direction, and the axis (i) is located above the axis (ii) in the vertical direction. A pressing-plate protrusion 422 is formed at a lower end of the pressing plate 404 in the vertical direction. Further, a pressing-plate regulating portion 421 is provided at a position inside the first liquid storage chamber 401, which is opposed to the pressing-plate protrusion 422. When the movable portion of the first liquid storage chamber 401 is displaced, the pressing-plate protrusion 422 of the pressing plate 404 is brought into contact with the pressing-plate regulating portion 421. In this manner, the pressing-plate regulating portion 421 regulates displacement of the pressing-plate protrusion 422 in a length direction (extension direction) of the negative-pressure spring 411.

With the configuration described above, as illustrated in FIG. 17B, when the volume of the first liquid storage chamber 401 increases, the movable portion of the first liquid storage chamber 401 is moved in such a manner as to be turned and displaced in a direction indicated by an arrow. Specifically, the movable portion of the first liquid storage chamber 401, which is under a state in which the pressing-plate protrusion 422 is in contact with the pressing-plate regulating portion 421, is turned and displaced about the pressing-plate protrusion 422 as a center of turning based on a relationship of equilibrium between the pressure in the first liquid storage chamber 401 and the spring force of the negative-pressure spring 411. In this configuration, when the valve 406 is opened, the flexible film 405 and the pressing plate 404 of the first liquid storage chamber 401 are regulated to be in a state in which the pressing-plate protrusion 422 is in contact with the pressing-plate regulating portion 421. Thus, when the valve 406 is opened, a force of the negative-pressure spring 411 for pressing the pressing plate 404 can be made constant. As described above, the pressing force of the negative-pressure spring 411 is a parameter that determines the pressure in the first liquid storage chamber 401. Thus, when the pressing force of the negative-pressure spring 411 is made constant, the pressure in the first liquid storage chamber 401 can also be made constant. The pressing-plate protrusion 422 is regulated to be in a state of being in contact with the pressing-plate regulating portion 421. Thus, when the valve 406 is opened, deformed states of the flexible film 405 and the pressing plate 404, which correspond to the movable portion, become always the same. Specifically, the movable portion has a fixed pressure-receiving area. As described above, the pressure-receiving area of the movable portion is a parameter that determines the pressure in the first liquid storage chamber 401. Thus, when the pressure-receiving area of the movable portion is fixed, the pressure in the first liquid storage chamber 401 can also be made constant.

(Configuration of Valve as Sealing Member)

Figure 18:
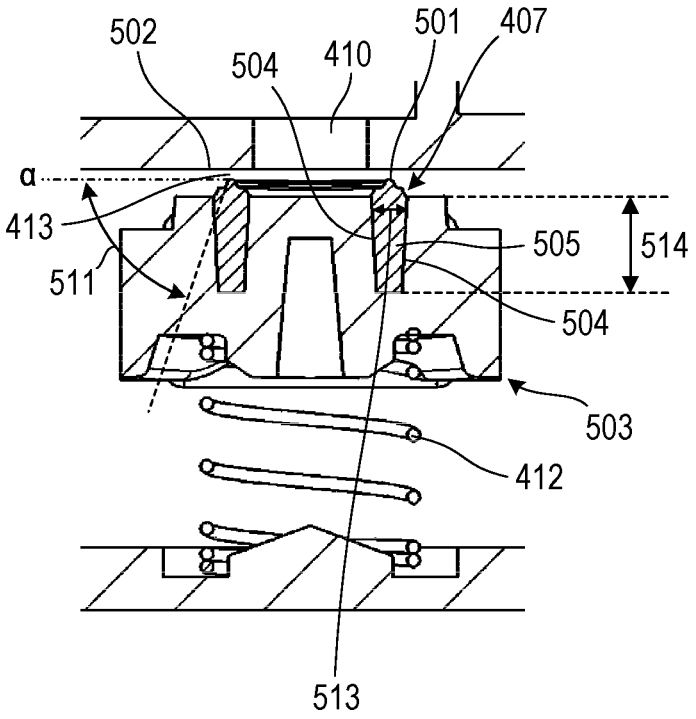
FIG. 18 is a sectional view for illustrating the valve and a vicinity thereof in the pressure adjustment mechanism.

Next, the valve portion 407 and the lever portion 503 of the valve 406 are described in detail. FIG. 18 is an enlarged sectional view for illustrating a main part of the valve 406, which is taken along the line B-B in FIG. 13B. As described above, the valve 406 is an example of the sealing member according to the present invention. The valve portion 407 corresponds to the elastic member in the sealing member, and the lever portion 503 corresponds to the base member in the sealing member. The valve 406 has a lever shape. The valve 406 excluding the valve portion 407 corresponds to the lever portion 503. The valve portion 407 is fixed to the lever portion 503. As illustrated in FIG. 15A, FIG. 15B, and FIG. 18, a valve distal end portion 501, which is a part of the valve portion 407, has an annular protruding shape so as to surround an outer periphery of the outflow port 410. The valve distal end portion 501 defines the gap 413 in cooperation with a gap defining surface 502 around the outflow port 410 to apply variable flow resistance. When the flow rate through the outflow port is to be set extremely small, the flow resistance is required to be set extremely large. Thus, the gap 413 is required to be reduced to have a micro-clearance. When the valve distal end portion 501 and the gap defining surface 502, which define the gap 413, have, for example, an inclination, undulation, or unevenness, a clearance remains even after the valve distal end portion 501 and the gap defining surface 502 are brought into contact with each other. Hence, it is difficult to further reduce the gap 413. Thus, in this embodiment, the valve distal end portion 501 is formed of an elastic member made of a soft material so as to extend along a surface shape of the gap defining surface 502. In this manner, for example, the inclination, undulation, or unevenness of the surface of the gap defining surface 502 can be absorbed, and hence an extremely small gap 413 can be formed. The valve distal end portion 501 having the annular protruding shape is an example of an annular abutment portion. The reason for the annular shape of the valve distal end portion 501, which corresponds to a part of the valve portion 407 being the elastic member, is described later.

As illustrated in FIG. 14B, a pressing pressure to be received by the pressing-plate contact portion 409 from the pressing plate 404, a reduced pressure in the second liquid storage chamber 403, which is to be received by the valve portion 407, and a spring load of the valve spring 412 are applied to the lever portion 503. With the above-mentioned forces, the lever portion 503 is subjected to bending moment about the shaft 408 as a center of rotation. When the lever portion 503 is deformed, a relationship between the magnitude of the gap 413 and a position of the pressing plate 404 changes from an original relationship. When the position of the pressing plate 404 changes along with the deformation of the lever portion 503, the pressure-receiving area of the pressing plate 404 and the load of the negative-pressure spring 411 change to thereby also change the pressure in the first liquid storage chamber 401. To keep a change in pressure in the first liquid storage chamber 401 small over a long period of time, the lever portion 503 of the valve 406, which includes the shaft 408, is required to have high stiffness. In particular, when the pressure adjustment mechanism is used for pressure adjustment of a heated liquid, stiffness decreases due to a temperature rise to increase deformation. Thus, it is preferred that the lever portion 503 be made of a material having high heat resistance. For example, in a case of the pressure adjustment mechanism to be provided in a liquid ejection apparatus, there is a high possibility that a liquid having a temperature increased to 30° C. or higher may flow into the pressure adjustment mechanism due to, for example, a temperature rise in the liquid ejection apparatus, temperature adjustment of the recording liquid, or heat generation in the recording element boards. When the liquid having an increased temperature flows into the pressure adjustment mechanism, the stiffness of the lever portion 503 decreases to increase warp or deformation of the lever portion 503. Then, the back pressure to be maintained by the pressure adjustment mechanism fluctuates. As a result, when the recording liquid is ejected as a liquid, recording quality may degrade.

Next, fixing of the valve portion 407, which is the elastic member, to the lever portion 503 is described. The pressure adjustment mechanism described herein is of back pressure type. Thus, a pressure in the second liquid storage chamber 403 is reduced by a pump (second circulation pump 1004 when the liquid ejection apparatus 2000 is used in the third circulation mode illustrated in FIG. 12) connected thereto. When the pressure in the second liquid storage chamber 403 is reduced, a force in a direction of narrowing the gap 413 is applied to a distal end area of the valve 406, which includes the valve distal end portion 501 and is opposed to the outflow port 410. Meanwhile, a force in a direction of increasing the gap 413 is applied to the lever portion 503 from the pressing plate 404. Thus, a force in a direction of separating the valve portion 407 from the lever portion 503 is applied to the valve portion 407 due to a reduced pressure in the second liquid storage chamber 403. As an example, a minimum pressure applied to the valve portion 407 as the reduced pressure is −5 kPa or smaller (the minimum pressure is a negative pressure in this case, and hence is 5 kPa or larger as an absolute value of an applied pressure). When the gap 413 is sufficiently smaller than a size of the valve 406, application of the force in the direction of narrowing the gap 413 is limited to a region opposed to the outflow port 410 and a periphery thereof. Thus, when the valve distal end portion 501 is formed in an annular shape so as to enable contact with the gap defining surface 502 at a position along an edge of the outflow port 410, an area to receive the reduced pressure can be set small, that is, set to only the area of the valve distal end portion 501 having an annular shape. When the area to receive the reduced pressure is reduced, the separating force from the lever portion 503, which is to be applied to the valve portion 407, is also reduced. Thus, a risk of separation of the valve portion 407, which is the elastic member, from the lever portion 503 made of a high-stiffness material is reduced. Thus, it is preferred that the valve distal end portion 501 be formed as an annular abutment portion.

It is also conceivable to use an adhesive as means for joining the valve portion 407 to the lever portion 503. When the adhesive is used, however, it is difficult to select an adhesive suitable for joining between the lever portion 503, which is made of a high-stiffness material and corresponds to the base member, and the valve portion 407, which is made of a soft material and corresponds to the elastic member. Besides, a component contained in the adhesive may melt into a liquid. For example, when the pressure adjustment mechanism including the valve portion 407 joined to the lever portion 503 with use of an adhesive is used in the liquid ejection apparatus, an adhesive component may melt into the recording liquid to generate a foreign substance in the recording liquid. As a result, clogging at the ejection orifice and the like may be caused.

Figure 19A:
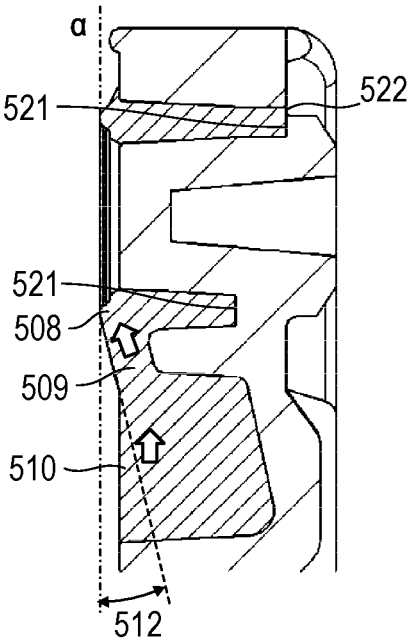
FIG. 19A, FIG. 19B, and FIG. 19C are sectional views for illustrating molding of the valve.
Figure 19B:
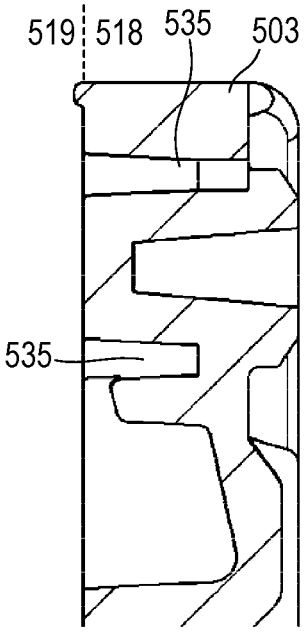

In this embodiment, a configuration in which the valve portion 407 is held in an annular groove formed in the lever portion 503 is employed to fix the valve portion 407 to the lever portion 503 without using an adhesive. As illustrated in FIG. 18, the valve portion 407 has not only the valve distal end portion 501 formed in an annular shape but also a held portion 505 having a tubular shape. The held portion 505 extends from the valve distal end portion 501 in a depth direction of the lever portion 503. The held portion 505 is fixed in such a manner that both side surfaces of the held portion 505 are sandwiched between a pair of side surfaces 504 of an annular groove 535 formed in the lever portion 503. In FIG. 18, the held portion 505 is already held in the annular groove 535, and hence the annular groove 535 is not illustrated alone. In FIG. 19B, however, the lever portion 503 before the fixing of the valve portion 407 thereto and the annular groove 535 are illustrated. The valve distal end portion 501 and the held portion 505 are formed integrally. The valve portion 407, which corresponds to the elastic member made of a soft material, has a cylindrical shape as a whole. A portion of the valve portion 407 which projects beyond the lever portion 503 is the valve distal end portion 501, and a tubular portion embedded in the lever portion 503 is the held portion 505. As described above, the valve 406 having the lever portion 503 and the valve portion 407 can be manufactured by, for example, a two-color molding technique. When the two-color molding technique is employed, the lever portion 503 is first formed through primary molding. After that, the valve portion 407 is molded through secondary molding. In the secondary molding, a resin is injected at a high pressure and supplied to the annular groove 535 formed in the lever portion 503 corresponding to the base member. As a result, the valve portion 407 is held in close contact with and fixed to the pair of side surfaces 504 of the annular groove 535 of the lever portion 503 in a state of being sandwiched between the pair of side surfaces 504. A region of the valve portion 407, which is fixed in a sandwiched manner, is in direct contact with the lever portion 503 corresponding to the base member.

To prevent separation of the valve portion 407 from the lever portion 503, a length for holding the held portion 505, which is held in the annular groove 535 along the depth direction of the lever portion 503, that is, a holding length 514 is set longer than a width 513 of the annular groove 535 in this embodiment. Specifically, it is preferred that the holding length 514 be set two or more times larger than the width 513 of the annular groove 535. The width of the annular groove 535 is a distance between the pair of side surfaces 504 of the annular groove 535, which are opposed to each other. When the annular groove 535 has a tapered shape as described later, the width of the annular groove 535 is defined as a width of the annular groove 535 on an upper end side. In this embodiment, a pressure-receiving area of the valve distal end portion 501 corresponding to the annular abutment portion for the reduced pressure is set small. Further, reliability of the fixing of the valve portion 407 to the lever portion 503 is further enhanced by determining a relationship between the width 513 of the annular groove 535 and the holding length 514. Further, in this valve 406, even a material having low compatibility with the material of the valve portion 407 corresponding to the elastic member can be used for lever portion 503 corresponding to the base member. Thus, material selectivity for the valve portion 407 and the lever portion 503 can be improved.

When the valve 406 is manufactured by injection molding including two-color molding, dies are opened after molding. In view of this process, the distance between the pair of side surfaces 504 of the annular groove 535 in the lever portion 503 is required to be gradually narrowed in the depth direction of the lever portion 503. Specifically, the annular groove 535 of the lever portion 503 is required to have a tapered sectional shape. However, in view of the prevention of separation of the valve portion 407 from the lever portion 503, it is preferred that an angle (that is, a taper angle) formed between the pair of side surfaces 504 opposed to each other be set to 20° or smaller. The angle formed between the pair of side surfaces 504 is defined as an angle formed between the pair of side surfaces 504 in a cross section of the lever portion 503. The cross section is taken along a plane that passes through a point inside the annular groove 535, contains a straight line extending in a width direction of the annular groove 535 at the point, and is parallel to the depth direction of the lever portion 503. Further, when a material having a smaller mold shrinkage rate than that of a resin material for forming the valve portion 407 is used as a resin material for forming the lever portion (base member) 503, a force of the valve portion 407 for inwardly tightening the side surfaces 504 of the annular groove 535 through shrinkage after the injection molding can be increased. Thus, fixing strength can be further increased.

To further increase the fixing strength of the valve portion 407 to the lever portion 503, a reinforcing portion 506 may be provided to the valve portion 407 as illustrated in FIG. 15A. The reinforcing portion 506 extends outward from the valve distal end portion 501 having an annular shape and the held portion 505. The lever portion 503 has the annular groove 535 with one pair of side surfaces 504 that hold the held portion 505 of the valve portion 407. Similarly, the lever portion 503 has a groove configured to hold at least part of the reinforcing portion 506. When the reinforcing portion 506 is formed, an area over which the lever portion 503 and the valve portion 407 are in direct contact with each other so as to hold the valve portion 407 is increased. Thus, the fixing strength of the valve portion 407 to the lever portion 503 can be further increased. A plurality of reinforcing portions 506 may be formed as needed in such a manner as to radially extend from the valve portion 407.

Figure 19C:
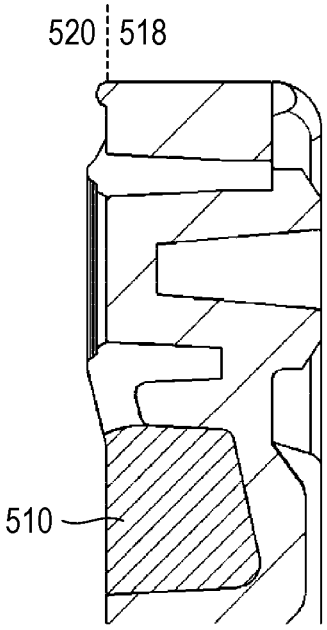

As described above, in the valve 406, a soft elastic material is required for the valve portion 407 corresponding to the elastic member, and a material having high stiffness is required for the lever portion 503 corresponding to the base member. Because of use of the materials having different kinds of characteristics, a plurality of components are required to be assembled. In the assembly of the valve 406, it is important to assemble the valve distal end portion 501, the lever portion 503, in particular, the shaft 408, and the pressing-plate contact portion 409 with high accuracy so as not to change a positional relationship between the gap 413 and the pressing plate 404. In addition, when the valve portion 407 is fixed to the lever portion 503, occurrence of undulation or deformation in the valve distal end portion 501 is required to be prevented. To satisfy such requirements, each of the valve portion 407 and the lever portion 503 is made of an injection-moldable material, and then, the valve portion 407 and the lever portion 503 are integrally assembled and molded in dies through two-color molding, which is one technique of the injection molding. As a result, the valve 406 can be formed by molding and assembly with high accuracy. Now, a method of molding and assembling the valve portion 407 corresponding to the elastic member and the lever portion 503 corresponding to the base member through the two-color molding is described with reference to FIG. 19A to FIG. 21. FIG. 19A is an enlarged sectional view of the valve portion 407 and the vicinity thereof, which is taken along the line C-C in FIG. 15A. In FIG. 19A, a state in which molding and assembly are completed is illustrated. FIG. 19B is a sectional view of the lever portion 503 after completion of the primary molding. FIG. 19C is a sectional view for illustrating a state in which a resin is being supplied in the secondary molding.

Figure 20:
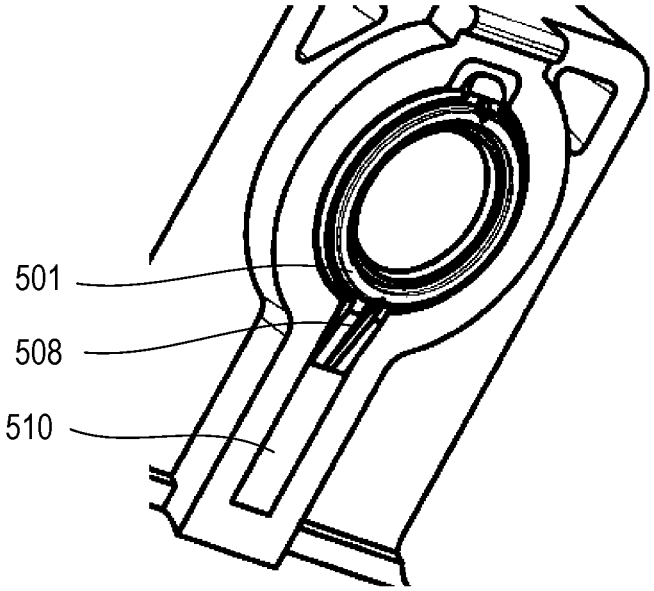
FIG. 20 is an enlarged perspective view for illustrating an annular abutment portion.
Figure 21:
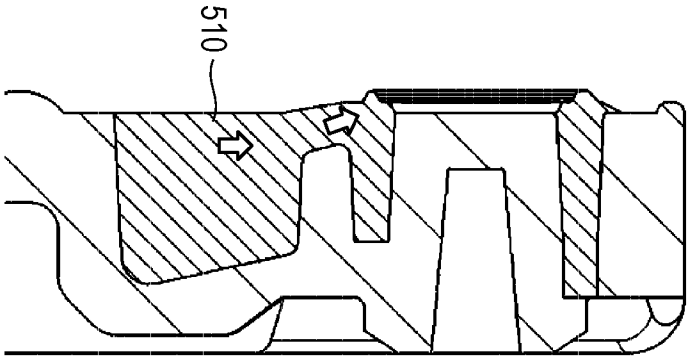
FIG. 21 is a sectional view for illustrating molding of the valve without a resin introduction path.

When the valve 406 is to be formed through the two-color molding, the lever portion 503 alone is first molded through the primary molding. The lever portion 503 having the annular groove 535 is formed through the primary molding. After the completion of the primary molding, a fixed-side die 519 and a movable-side die 518, which are used in the primary molding, are separated apart at a die matching plane indicated by a broken line in FIG. 19B. At this time, the lever portion 503 is in a state of adhering to the movable-side die 518. After that, for the secondary molding, the movable-side die 518 is moved closer to a fixed-side die 520 for secondary molding together with the lever portion 503. Then, the dies are closed. As a result, the fixed-side die 520 for secondary molding is brought into contact with the lever portion 503, which has already been molded. After that, as illustrated in FIG. 19C, a resin for secondary molding is injected through a secondary molding gate 510 to be supplied to a space defined by the lever portion 503 and the fixed-side die 520. As illustrated in FIG. 19A, the fixed-side die 520 has a resin introduction path 508 extending in a gate direction. The resin introduction path 508 is formed at a position corresponding to the valve distal end portion 501. The resin injected into the dies through the gate 510 passes from a resin introduction port 509 through the resin introduction path 508 to be smoothly supplied to the valve distal end portion 501, as indicated by arrows in FIG. 19A. FIG. 20 is an enlarged view of the valve portion 407 of the valve 406, that is, a portion having the annular abutment portion. A position of the gate 510 to be used in the secondary molding and the resin introduction path 508 after the molding are illustrated. Without the resin introduction path 508, the resin injected from the resin introduction port 509 is less likely to be supplied to a position corresponding to the valve distal end portion 501 because the valve distal end portion 501 is narrow and steep as illustrated in FIG. 21. Thus, gas is liable to remain. When the gas remains, a recess is formed in the valve distal end portion 501 corresponding to the annular abutment portion. The recess may prevent the contact of the valve distal end portion 501 and the gap defining surface 502 without a clearance. As a result, the pressure adjustment mechanism may not satisfactorily function as a back pressure-type pressure adjustment mechanism. Thus, it is preferred that the resin introduction path 508 be formed. The resin supplied to the resin introduction path 508 remains even after the molding. Thus, the resin in the resin introduction path 508 may be used as the reinforcing portion 506 described above. It is preferred that a position at which the resin introduction path 508 is connected to the valve distal end portion 501 be as close as possible to a distal end of the valve distal end portion 501 and be at a protrusion distal end portion of the valve distal end portion 501, which is an annular protrusion. Further, it is preferred that an angle 512 formed by a direction in which the resin introduction path 508 extends with respect to a plane a defined by the protrusion distal end portion be smaller than an angle 511 (see FIG. 18) formed between the plane a and an outer surface of the valve distal end portion 501 at the protrusion distal end portion, more preferably, be 30° or smaller.

In this embodiment, the annular groove 535 is formed in the lever portion 503, and the valve portion 407 is held between both side surfaces 504 of the annular groove 535. In the lever portion 503, a through hole 522 for degassing is formed in a bottom portion 521 of the annular groove 535. When the valve portion 407 corresponding to the elastic member is injection-molded, gas is more liable to remain in the last portion to be supplied with the resin. When the gas remains, for example, the lever portion 503 of the valve portion 407 may separate or the valve portion 407 may be deformed due to expansion of the remaining gas, which is caused by a change in temperature. With the through hole 522, the gas in the last portion supplied with the resin can be released to the movable-side die 518. Thus, a residual gas can be reduced. Even when the valve portion 407 and the lever portion 503 are individually molded and assembled without using the two-color molding, air remaining in the space between the valve portion 407 and the lever portion 503 at a time of assembly can be released. Thus, a failure, which may be caused along with expansion of air, can be prevented.

When the lever portion 503 and the valve portion 407 are assembled and molded through injection molding as described above, accuracy of a position of the valve distal end portion 501 of the valve portion 407 to be fixed to the lever portion 503 is determined depending on the dies. Thus, the valve 406 can be formed by assembly with high accuracy. As an example of the resin material for molding the valve portion 407, there is given a styrene-based elastomer, which is a thermoplastic elastomer. As an example of the resin material for molding the lever portion 503 corresponding to the base member required to have high stiffness, modified polyphenylene ether is preferred. Modified polyphenylene ether with addition of, for example, polystyrene, polyolefin, or a filler may also be used. An assembly method using the two-color molding is an example of a method of forming the valve 406. The valve 406 may be assembled through insert molding for inserting the lever portion 503 formed by molding into the dies and molding the valve portion 407. As another assembly method, the following method is also used. Specifically, the valve portion 407 and the lever portion 503 are individually molded. The held portion 505 of the valve portion 407 is heated to be softened. Then, the held portion 505 is inserted into the annular groove 535, which is formed in advance in the lever portion 503. The materials and the assembly methods described above are mere examples, and materials and assembly methods of the present invention are not limited thereto.

(Pressure-Reducing Type Pressure Adjustment Mechanism)

Figure 22A:
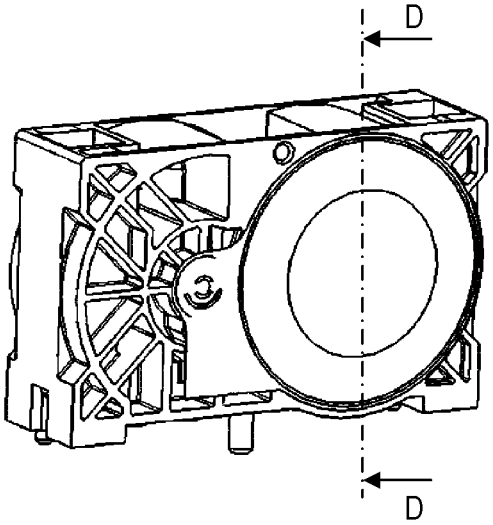
FIG. 22A and FIG. 22B are views for illustrating a pressure-reducing type pressure adjustment mechanism.
Figure 22B:
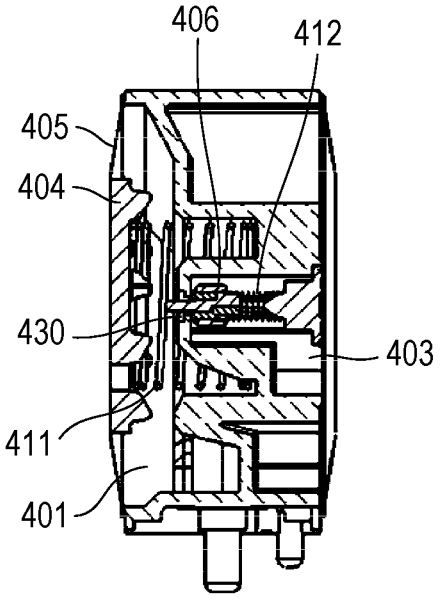

The sealing member according to the present invention, which is used as the valve configured to perform pressure loss adjustment for back-pressure control in the back-pressure type pressure adjustment mechanism, has been described above. However, the sealing member of the present invention is not limited to that described above. The sealing member according to the present invention may also be used for, for example, a pressure-reducing type pressure adjustment mechanism, various kinds of valves such as a check valve, or a gasket for sealing. Now, the sealing member according to the present invention, which is used as a valve in a pressure-reducing type pressure adjustment mechanism, is described. FIG. 22A is an exterior perspective view for illustrating a pressure-reducing type pressure adjustment mechanism. FIG. 22B is a sectional view taken along the line D-D in FIG. 22A. The pressure-reducing type pressure adjustment mechanism described herein can be used in, for example, the pressure control unit 230 operating in the first circulation mode illustrated in FIG. 2.

Similarly to the back-pressure type pressure adjustment mechanism described above, the pressure-reducing type pressure adjustment mechanism includes the first liquid storage chamber 401, the second liquid storage chamber 403, the pressing plate 404, the flexible film 405, the valve 406, the negative-pressure spring 411, and the valve spring 412. The pressing plate 404 is fixed with the flexible film 405, and is urged by the negative-pressure spring 411 to be displaced in accordance with an increase or decrease in amount of liquid in the first liquid storage chamber 401. The valve 406, which is the sealing member, is urged by the valve spring 412 in a direction of closing an opening 430 configured to bring the second liquid storage chamber 403 and the first liquid storage chamber 401 into communication with each other. The pressure adjustment mechanism is of pressure-reducing type, and hence the amount of flow is required to be controlled in accordance with a pressure on a downstream side of flow. The liquid flows in a direction from the second liquid storage chamber 403 toward the first liquid storage chamber 401. When the first liquid storage chamber 401 shrinks, the pressing plate 404 presses the valve 406 against an urging force of the valve spring 412. As a result, the valve 406 is moved away from the opening 430 between the second liquid storage chamber 403 and the first liquid storage chamber 401 to reduce flow resistance at the opening 430. In other words, in this pressure adjustment mechanism, when the pressing plate 404 is displaced in a direction of expanding the first liquid storage chamber 401, the valve 406 is moved closer to the opening 430 to increase flow resistance to the liquid flowing out via the opening 430. In the pressure adjustment mechanism, when the pressure in the first liquid storage chamber 401 increases, the first liquid storage chamber 401 expands to increase the flow resistance to the liquid flowing into the first liquid storage chamber 401 via the opening 430. Thus, the pressure adjustment mechanism operates so as to keep the pressure of the liquid in the first liquid storage chamber 401 constant.

Figure 23A:
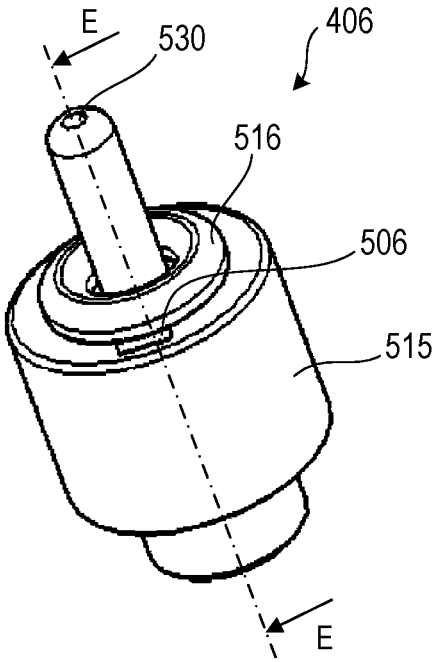
FIG. 23A and FIG. 23B are views for illustrating a valve to be used in the pressure adjustment mechanism illustrated in FIG. 22A and FIG. 22B.
Figure 23B:
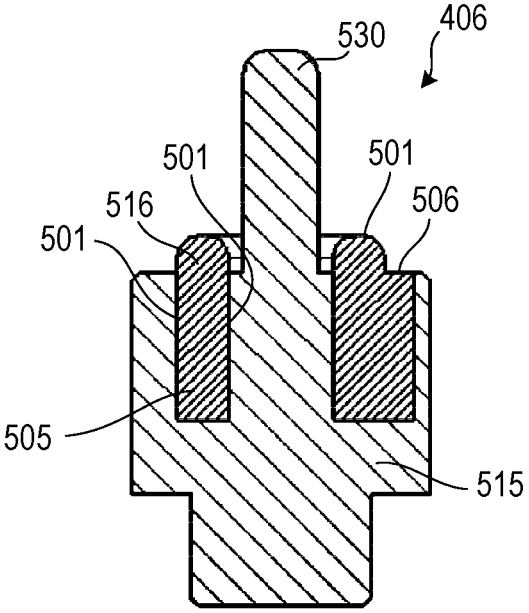

FIG. 23A is an exterior perspective view of the valve 406 to be used in the pressure-reducing type pressure adjustment mechanism illustrated in FIG. 22A and FIG. 22B. FIG. 23B is a sectional view taken along the line E-E in FIG. 23A. The valve 406 is formed in a shape of a rotating body having the line E-E as a center axis as a whole. The valve 406 includes a base member 515 and an elastic member 516. The base member 515 has a pressing-plate contact portion 530. The elastic member 516 has a reinforcing portion 506. The base member 515 has a substantially columnar shape. The pressing-plate contact portion 530 having a bar-like shape extends from one end of the base member 515 along the center axis of the valve 406. The pressing-plate contact portion 530 is configured to be brought into contact with the pressing plate 404 so that the valve 406 is moved in accordance with the displacement of the pressing plate 404. The elastic member 516 having a substantially cylindrical shape is joined and fixed to the base member 515 so as to be coaxial therewith. One end portion of the elastic member 516 projects from the base member 515 as an annular protruding portion in such a manner as to surround the pressing-plate contact portion 530, and serves as the valve distal end portion 501 being the annular abutment portion. The remaining portion of the elastic member 516 is embedded as the held portion 505 in an annular groove formed in the base member 515, and is held in a sandwiched manner between the pair of side surfaces 504 of the annular groove. Even in this case, a holding length over which the annular groove holds the held portion 505 along a depth direction of the base member 515 is larger than a width of the annular groove. Thus, the degree of contact of the held portion 505 with the base member 515 is increased. Further, the elastic member 516 has the reinforcing portion 506. The base member 515 also holds the reinforcing portion 506 to thereby increase fixing strength. In this manner, a risk of separation of the elastic member 516 from the base member 515 is further lowered. Further, even a material having low compatibility with a material for forming the elastic member 516 can be used for the base member 515. Thus, material selectivity for the base member 515 can be improved. When a material having high strength is used for the base member 515, a pressure-reducing type pressure adjustment mechanism having high reliability over a long period of time can be achieved. Further, components can be downsized, and hence the pressure adjustment mechanism can also be downsized. In turn, a liquid ejection apparatus including the pressure adjustment mechanism can also be downsized.

(Cap Member)

Figure 24A:
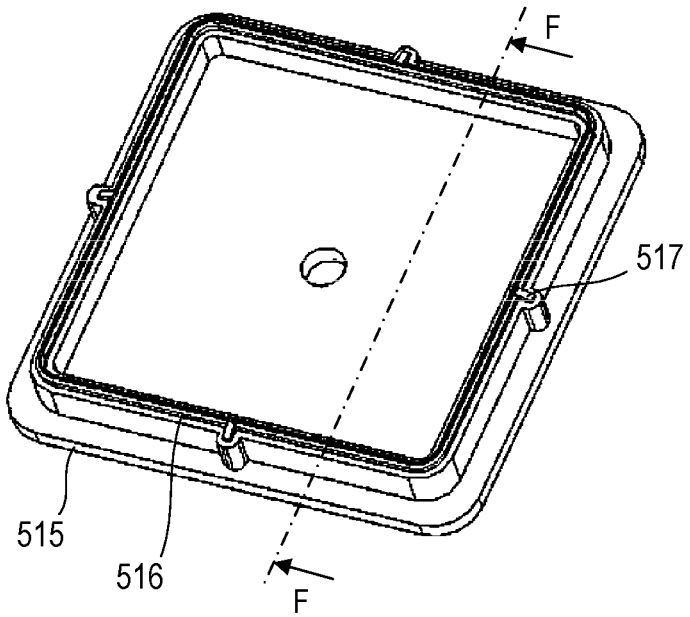
FIG. 24A and FIG. 24B are views for illustrating a cap member.
Figure 24B:
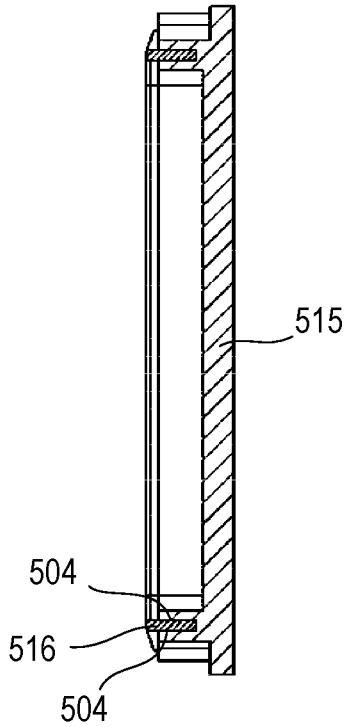

Next, another application of the sealing member according to the present invention is described. The sealing member according to the present invention can also be used as a cap member configured to cover a liquid ejection head when the liquid ejection device is not in use or in a standby state to suppress evaporation of a recording liquid from ejection orifices. FIG. 24A is a perspective view of a cap member formed of a sealing member according to the present invention. FIG. 24B is a sectional view taken along the line F-F in FIG. 24A. When the elastic member 516 formed in an annular shape is brought into contact with a surface of a liquid ejection head, which has ejection orifices, the cap member covers the liquid ejection head to suppress evaporation of the recording liquid from the ejection orifices. Further, when a pressure in a space surrounded by the elastic member 516 having an annular shape is reduced by a pump, the recording liquid can be sucked from the liquid ejection head to enable removal of, for example, a foreign substance in the vicinity of the ejection orifice. The elastic member 516 is fixed to the base member 515 in the above-mentioned manner. Further, in the cap member, the elastic member 516 has reinforcing portions 517. When the base member 515 holds at least part of the reinforcing portions 517, a risk of separation of the elastic member 516 from the base member 515 is further reduced. This cap member also allows selection of a material having high stiffness for the base member 515 while preventing separation of the elastic member 516 from the base member 515. As a result, reliability of the cap member can be enhanced.

According to the present invention, a sealing member with high reliability, which includes a base member having high strength and is to be used in, for example, a pressure adjustment mechanism, a method of manufacturing the sealing member, a pressure adjustment mechanism using the sealing member, a liquid ejection head, and a liquid ejection apparatus can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-146590, filed Sep. 1, 2020, and Japanese Patent Application No. 2021-079808, filed May 10, 2021, which are hereby incorporated by reference herein in their entirety.

What is claimed is:

1. A sealing member comprising:

an elastic member having an annular abutment portion formed as an annular protrusion; and a base member to which the elastic member is to be fixed, wherein the elastic member has a held portion having a tubular shape extending from the annular abutment portion and is fixed to the base member when the held portion is held in an annular groove formed in the base member, and a holding length over which the annular groove holds the held portion along a depth direction of the base member is longer than a width of the annular groove, and wherein the elastic member has a reinforcing portion extending from the annular abutment portion and the held portion to an outside of the annular abutment portion, and at least part of the reinforcing portion is held in a groove formed in the base member.

2. The sealing member according to claim 1, wherein the annular groove has a pair of side surfaces to be brought into direct contact with the held portion of the elastic member.

3. The sealing member according to claim 1, wherein the base member and the elastic member are made of resin materials, respectively, and the resin material for forming the base member has a mold shrinkage rate smaller than a mold shrinkage rate of the resin material for forming the elastic member.

4. The sealing member according to claim 1, wherein the holding length is two or more times larger than the width of the annular groove.

5. The sealing member according to claim 1, wherein, in a cross section of the base member, the cross section being taken along a plane that passes through a point inside the annular groove, contains a straight line extending in a width direction of the annular groove at the point, and is parallel to the depth direction of the base member, an angle formed between a pair of side surfaces of the annular groove is equal to or smaller than 20°.

6. The sealing member according to claim 1, wherein the base member has a through hole that is formed in a bottom portion of the annular groove in such a manner as to pass through the base member.

7. A method of manufacturing a sealing member comprising an elastic member having an annular abutment portion formed as an annular protrusion and a base member to which the elastic member is to be fixed, wherein the elastic member and the base member are integrally assembled and molded in two or more dies through injection molding, wherein one of the dies is for molding of the elastic member and has a resin introduction port configured to allow a resin to flow from a gate to the annular abutment portion and a resin introduction path extending from the resin introduction port to a protrusion distal end portion of the annular abutment portion.

8. The method of manufacturing a sealing member according to claim 7, wherein an angle formed by a direction in which the resin introduction path extends with respect to a plane defined by the protrusion distal end portion is smaller than an angle formed between the plane and an outer surface of the annular abutment portion at the protrusion distal end portion.

9. The method of manufacturing a sealing member according to claim 8, wherein the angle formed by the direction in which the resin introduction path extends with respect to the plane is equal to or smaller than 30°.

10. A pressure adjustment mechanism comprising:

a liquid storage chamber, which has an outer wall formed at least partially of a flexible film, and is configured to store a liquid;

an opening configured to communicate with the liquid storage chamber;

a pressing plate configured to be displaced in accordance with displacement of the flexible film;

a first urging member configured to urge the pressing plate in a direction of expanding the liquid storage chamber; and the sealing member of claim 1, wherein the sealing member is arranged in such a manner that a distance between the elastic member of the sealing member and the opening is changed in accordance with the displacement of the pressing plate to change flow resistance to the liquid flowing through the opening so as to adjust a pressure of the liquid in the liquid storage chamber.

11. The pressure adjustment mechanism according to claim 10, further comprising a second urging member configured to urge the sealing member in a direction of closing the opening with the elastic member, wherein the pressure adjustment mechanism comprises a back-pressure type pressure adjustment mechanism in which, when the pressing plate is displaced in a direction of expanding the liquid storage chamber, the elastic member is moved away from the opening to reduce the flow resistance to the liquid flowing out from the liquid storage chamber via the opening.

12. The pressure adjustment mechanism according to claim 11, wherein the sealing member includes the base member formed in a lever shape and a shaft about which the sealing member is turnable, and the base member has one end at which the elastic member is provided and another end to be brought into contact with the pressing plate when viewed from the shaft, and wherein a distance between the elastic member and the opening changes through turning of the sealing member about the shaft.

13. The pressure adjustment mechanism according to claim 10, further comprising a second urging member configured to urge the sealing member in a direction of closing the opening with the elastic member, wherein the pressure adjustment mechanism comprises a pressure-reducing type pressure adjustment mechanism in which, when the pressing plate is displaced in the direction of expanding the liquid storage chamber, the elastic member is moved closer to the opening to increase the flow resistance to the liquid flowing into the liquid storage chamber via the opening.

14. A liquid ejection head comprising:

a plurality of recording element boards each including:

ejection orifices;

recording elements configured to generate energy for ejecting a liquid from the ejection orifices; and a pressure chamber including the recording elements;

a pair of common flow paths configured to communicate with the plurality of recording element boards;

a plurality of individual flow paths configured to connect one of the pair of common flow paths to another one of the common flow paths and communicate with the plurality of pressure chambers, respectively; and a pair of the pressure adjustment mechanisms of claim 10, which are to be connected to one of an upstream side and a downstream side of the pair of common flow paths, and are to be set at pressures different from each other.

15. A liquid ejection apparatus comprising:

a liquid storage reservoir configured to store a liquid;

the liquid ejection head of claim 14; and a circulation mechanism configured to circulate the liquid through a circulation path including the pair of common flow paths.

* * * * *